US009927741B2

(12) United States Patent
Noguchi et al.

(10) Patent No.: US 9,927,741 B2
(45) Date of Patent: Mar. 27, 2018

(54) IMAGE FORMING APPARATUS

(71) Applicant: CANON KABUSHIKI KAISHA, Tokyo (JP)

(72) Inventors: Akihiro Noguchi, Toride (JP); Haruhiko Omata, Abiko (JP); Tatsuomi Murayama, Abiko (JP); Yasuki Kamimori, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/194,756

(22) Filed: Jun. 28, 2016

(65) Prior Publication Data

US 2017/0003623 A1 Jan. 5, 2017

(30) Foreign Application Priority Data

Jul. 2, 2015 (JP) ..... 2015-133805

(51) Int. Cl.
*G03G 15/16* (2006.01)
*G03G 15/23* (2006.01)
*G03G 15/02* (2006.01)

(52) U.S. Cl.
CPC ..... *G03G 15/161* (2013.01); *G03G 15/234* (2013.01); *G03G 15/0225* (2013.01); *G03G 15/168* (2013.01); *G03G 2215/1661* (2013.01)

(58) Field of Classification Search
CPC .. G03G 15/161; G03G 15/231–15/235; G03G 2215/1647–2215/1661; G03G 2221/0036–2221/0042; G03G 2221/0063
See application file for complete search history.

(56) References Cited

U.S. PATENT DOCUMENTS

| | | | | |
|---|---|---|---|---|
| 7,486,900 | B2 | 2/2009 | Omata | |
| 8,472,824 | B2 | 6/2013 | Yamaki et al. | |
| 2010/0040386 | A1* | 2/2010 | Mizutani | G03G 15/161 399/44 |
| 2012/0020693 | A1* | 1/2012 | Yamaki | G03G 15/161 399/71 |

(Continued)

FOREIGN PATENT DOCUMENTS

| | | | |
|---|---|---|---|
| JP | 07219292 | A * | 8/1995 |
| JP | 2002-244386 | A | 8/2002 |

(Continued)

*Primary Examiner* — Sevan A Aydin
(74) *Attorney, Agent, or Firm* — Fitzpatrick, Cella, Harper & Scinto

(57) ABSTRACT

An image forming apparatus includes an intermediary transfer member, a toner image forming unit, a rotatable transfer member, a cleaning unit, a feeding unit, a feeding portion and an executing portion configured to execute a supplying operation for supplying a supplying toner image to a cleaning portion. The executing portion forms the supplying toner image at a position including a position different from a position where an adjusting toner image for adjusting an image forming condition is formed, with respect to a widthwise direction crossing a movement direction of an intermediary transfer member provided in contact with the rotatable transfer member. The executing portion performs the supplying operation at least one time in a double-sided image forming job and does not perform the supplying operation in a single-sided image forming job.

6 Claims, 22 Drawing Sheets

(56) References Cited

U.S. PATENT DOCUMENTS

| | | | | |
|---|---|---|---|---|
| 2014/0147135 | A1* | 5/2014 | Ogino | G03G 15/161 399/38 |
| 2016/0091832 | A1 | 3/2016 | Omata et al. | |
| 2016/0306303 | A1* | 10/2016 | Ueno | G03G 15/161 |

FOREIGN PATENT DOCUMENTS

| | | | |
|---|---|---|---|
| JP | 2006-030849 | | 2/2006 |
| JP | 2011-191485 | A | 9/2011 |
| JP | 2012-002904 | A | 1/2012 |
| JP | 2013-007796 | | 1/2013 |
| JP | 2013-156446 | A | 8/2013 |

* cited by examiner

IMAGE FORMING APPARATUS

FIELD OF THE INVENTION AND RELATED ART

The present invention relates to an image forming apparatus for forming an image on a recording material with the use of an electrophotographic method (type) or the like.

Conventionally, there has been known an image forming apparatus of an intermediary transfer type in which a toner image formed on a photosensitive drum is primary-transferred onto an intermediary transfer member, and then, is secondary-transferred onto a recording material at a transfer nip formed between a secondary transfer belt and the intermediary transfer member.

In image forming apparatuses in recent years, in order to facilitate separation of the recording material from a fixing device for the purpose of meeting speed-up, a toner containing a wax has been used. In the case where images are formed on both surfaces of the recording material with this toner, the recording material after an end of the image formation on a first surface (front surface) is heated for fixing the toner (image) thereon and thus has heat, and therefore is in a state in which the melted wax bleeds from the recording material. When the recording material on which the wax bleeds therefrom is turned upside down and then is subjected to subsequent image formation on a second surface (back surface), the wax can be deposited on a secondary transfer belt by being moved from the first surface (front surface) of the recording material onto the secondary transfer member.

The wax deposited on the secondary transfer member can generate image non-uniformity during image formation and can cause an image defect such that an image density decreases. Therefore, Japanese Laid-Open Patent Application (JP-A) 2013-7796 discloses an image forming apparatus in which in order to remove the wax deposited on the secondary transfer member, the wax deposited on the secondary transfer member is melted by heating the secondary transfer member and then the melted wax is collected by a wax collecting means. Further, JP-A 2012-2904 discloses an image forming apparatus in which deposition of the wax on the secondary transfer member is suppressed by applying a lubricant onto the surface of the secondary transfer member while removing the wax by a cleaning member and an auxiliary cleaning member.

However, in the image forming apparatus disclosed in JP-A 2013-7796, a heating means for heating the secondary transfer member and the wax collecting means are provided, and in the image forming apparatus disclosed in JP-A 2012-2904, a mechanism for applying the lubricant and an auxiliary cleaning means are provided. Therefore, the image forming apparatuses are liable to become complicated and are liable to becomes high in cost. Further, the wax scraped off the secondary transfer member by a cleaning blade was accumulated and deposited between an edge portion of the cleaning blade and the secondary transfer member, so that a lump of the wax was liable to generate. When the lump of the wax is generated, improper cleaning such that the toner passes through the cleaning blade occurs, with the result that a stripe image defect is liable to be produced on the metal roller, for example.

SUMMARY OF THE INVENTION

According to an aspect of the present invention, there is provided an image forming apparatus comprising: a movable intermediary transfer member; a toner image forming unit configured to form a toner image on the intermediary transfer member with a toner containing a wax; a rotatable transfer member configured to form a transfer portion in contact with the intermediary transfer member, wherein in the transfer portion, a transfer electric field for transferring the toner image from the intermediary transfer member onto a recording material fed to the transfer portion is formed; a cleaning unit, including a brush member, a rotatable member and a blade member, configured to electrostatically remove the toner on the rotatable transfer member, wherein the brush member has electroconductivity and electrostatically attracts the toner on the rotatable transfer member in contact with the rotatable transfer member while being rotated, wherein a voltage is applied to the rotatable member, and the toner attracted to the brush member in contact with the brush member is electrostatically attracted and moved to the rotatable member, wherein the blade member contacts the rotatable member at a cleaning portion and scrapes the toner off the rotatable member with rotation of the rotatable member; a fixing unit configured to fix the toner image on the recording material by heating the recording material, on which the toner image is transferred at the transfer portion, together with the toner image; a feeding portion configured to feed to the transfer portion the recording material after passing through the fixing unit, wherein when a double-sided job for forming an image on one surface of the recording material and then for forming an image on the other surface of the recording material is performed, the feeding portion feeds the recording material, on which the image is formed on the one surface, so that the one surface faces toward the rotatable transfer member at the transfer portion; an executing portion configured to execute a supplying operation for supplying the toner to the cleaning portion during an image forming job for forming the image on the recording material, by forming a supplying toner image on the intermediary transfer member and by transferring the supplying toner image onto the rotatable transfer member in a period in which there is no recording material at the transfer portion and then by carrying the supplying toner image to the cleaning portion through the brush member and the rotatable member, wherein the executing portion forms the supplying toner image at a position including a position different from a position where an adjusting toner image for adjusting an image forming condition is formed, with respect to a widthwise direction crossing a movement direction of the intermediary transfer member, and wherein the executing portion performs the supplying operation at least one time when image formation on a predetermined number of recording materials is effected in the double-sided job, and does not perform the supplying operation when the image formation on the predetermined number of recording materials is effected in a single-sided job for forming an image on only one surface of the recording material.

According to another aspect of the present invention, there is provided an image forming apparatus comprising: a movable intermediary transfer member; a toner image forming unit configured to form a toner image on the intermediary transfer member with a toner containing a wax; a rotatable transfer member configured to form a transfer portion in contact with the intermediary transfer member, wherein in the transfer portion, a transfer electric field for transferring the toner image from the intermediary transfer member onto a recording material fed to the transfer portion is formed; a blade member configured to remove the toner on the rotatable transfer member, wherein the blade member contacts the rotatable transfer member at a cleaning portion and scrapes the toner off the rotatable transfer member with rotation of the rotatable transfer member; a fixing unit configured to fix the toner image on the recording material by heating the recording material, on which the toner image is transferred at the transfer portion, together with the toner image; a feeding portion configured to feed to the transfer portion the recording material after passing through the fixing unit, wherein when a double-sided job for forming an image on one surface of the recording material and then for forming an image on the other surface of the recording material is performed, the feeding portion feeds the recording material, on which the image is formed on the one surface, so that the one surface faces toward the rotatable transfer member at the transfer portion; an executing portion configured to execute a supplying operation for supplying the toner to the cleaning portion during an image forming job for forming the image on the recording material, by forming a supplying toner image on the intermediary transfer member and by transferring the supplying toner image onto the rotatable transfer member in a period in which there is no recording material at the transfer portion and then by carrying the supplying toner image to the cleaning portion, wherein the executing portion forms the supplying toner image at a position including a position different from a position where an adjusting toner image for adjusting an image forming condition is formed, with respect to a widthwise direction crossing a movement direction of the intermediary transfer member, and wherein the executing portion performs the supplying operation at least one time when image formation on a predetermined number of recording materials is effected in the double-sided job, and does not perform the supplying operation when the image formation on the predetermined number of recording materials is effected in a single-sided job for forming an image on only one surface of the recording material.

Further features of the present invention will become apparent from the following description of exemplary embodiments (with reference to the attached drawings).

DESCRIPTION OF THE EMBODIMENTS

First Embodiment

Figure 1:
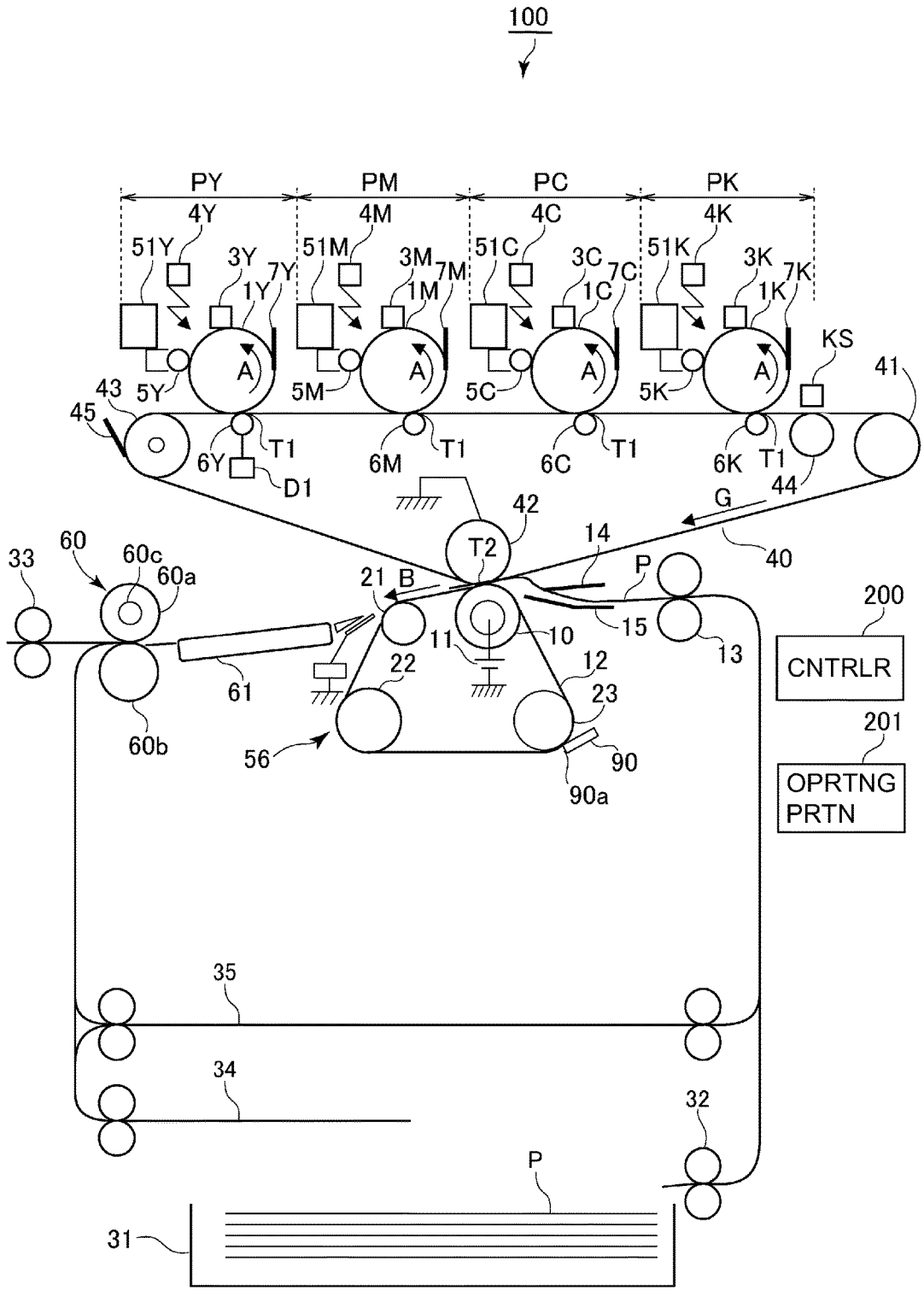
FIG. 1 is a schematic view showing a structure of an image forming apparatus in First Embodiment.
Figure 2:
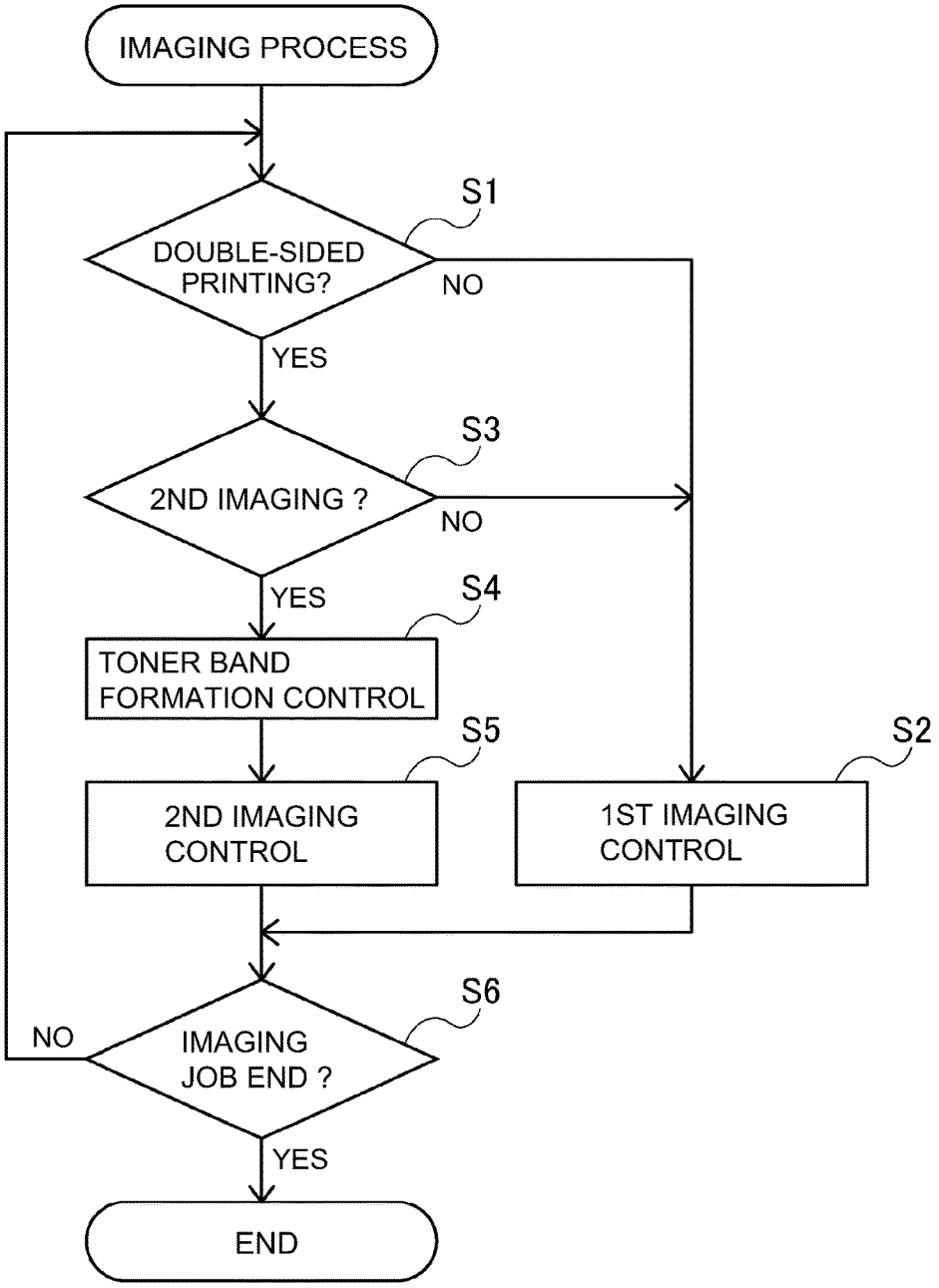
FIG. 2 is a flowchart showing an image forming process in First Embodiment.
Figure 3:
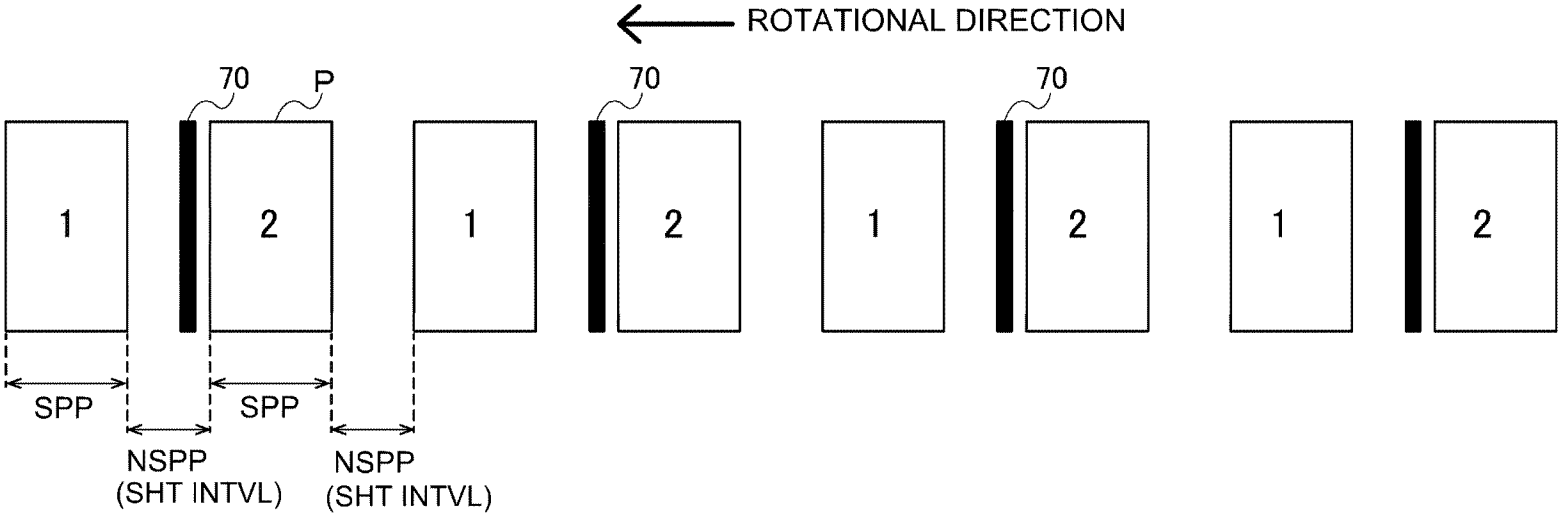
FIG. 3 is a schematic view for illustrating a toner band formed in First Embodiment.

Referring to FIGS. 1-3, First Embodiment of the present invention will be described. To begin with, referring to FIG. 1, an image forming apparatus in this embodiment will be described.

<Image Forming Apparatus>

An image forming apparatus 100 is a multi-color printer of a tandem type and of an intermediary transfer type, in which a plurality of yellow, magenta, cyan and black image forming portions PY, PM, PC and PK are provided along an intermediary transfer belt 40.

In this image forming portion PY, a yellow toner image is formed on a photosensitive drum 1 and is primary-transferred onto the intermediary transfer belt 40. In the image forming portion PM, a magenta toner image is formed on a photosensitive drum 1M and is primary-transferred superposedly onto the yellow toner image on the intermediary transfer belt 40. In the image forming portions PC and PK, cyan and black toner images are formed on photosensitive drums 1C and 1K, respectively, and are sequentially transferred superposedly onto the yellow and magenta toner images on the intermediary transfer belt 40. The intermediary transfer belt 40 rotates while carrying the toner images.

A recording material P (paper, sheet material such as an OHP sheet or the like) is taken out from a recording material cassette 31 by a pick-up roller 32 and is sent to a registration roller pair 13. The registration roller pair 13 sends the recording material P to a secondary transfer portion T2 by timing the recording material P to the toner images on the intermediary transfer belt 40. The recording material P on which the four color toner images are secondary-transferred is sent to a fixing device 60, in which the recording material P is subjected to heat and pressure by a heating roller 60*a* and a pressing roller 50*b* which are used as heating means. As a result, the toner images on the recording material P are heated and fixed on the recording material P.

<Image Forming Portion>

The image forming portions PY, PM, PC and PK are substantially the same in structure except that they are different in the color (yellow, magenta, cyan and black, respectively) of the toners they use. Therefore, in the following, the image forming portion PY will be described in detail, and as regards the image forming portions PM, PC and PK, constituent elements thereof will be described by reading the suffixes Y of symbols as M, C and K, respectively.

The image forming portion PY includes, around the photosensitive drum 1Y, a charging device 3Y, an exposure device 4Y, a developing device 5Y, a primary transfer roller 6Y, and a drum cleaning device 7Y. The photosensitive drum 1Y as an image bearing member is a drum-shaped electrophotographic photosensitive member which is rotatably supported by an apparatus main assembly, and is rotated by an unshown photosensitive drum driving motor at a predetermined process speed in the counterclockwise direction (indicated by arrow A in FIG. 1).

The charging device 3Y uniformly charges the surface of the photosensitive drum 1Y, by being supplied with an oscillating voltage in the form of a negative DC voltage biased with an AC voltage, so that the charging device 3Y charges the surface of the photosensitive drum 4Y to a uniform negative dark portion potential. The exposure device 4Y writes (forms) an electrostatic latent image on the charged surface of the photosensitive drum 1Y by scanning, through a rotating mirror, the surface of the photosensitive drum 1Y with a laser beam obtained by ON-OFF modulating scanning line image data developed from separated color images of the respective colors.

The developing device 5Y develops the electrostatic latent image into a toner image by supplying a toner, charged to a negative polarity to the photosensitive drum 1Y. In the developing device 5Y, an unshown developing sleeve disposed with a slight gap from the surface of the photosensitive drum 1Y is rotated counterdirectionally to the photosensitive drum 1Y. The developing device 5Y charges a two-component developer containing a toner and a carrier, and conveys the developer to an opposing portion to the photosensitive drum 1Y while carrying the developer on the developing sleeve. The oscillating voltage in the form of a DC voltage biased with an AC voltage is applied to the developing sleeve, so that the negatively charged toner is moved to an exposed portion of the photosensitive drum 1Y which is positive relative to the negatively charged toner, and thus the electrostatic latent image is developed reversely. A developer supplying portion 51Y supplies a developer for supply to the developing device 5Y depending on toner consumption with image formation or the like.

The primary transfer roller 6Y forms the primary transferring portion T1 between the photosensitive drum 1Y and the intermediary transfer belt 40 by pressing the intermediary transfer belt 40. A primary transfer high-voltage (power) source D1 is connected to, and applies a primary transfer bias (voltage) of the positive polarity to, the primary transfer roller 6Y, whereby the negatively charged toner image on the photosensitive drum 1Y is transferred onto the intermediary transfer belt 40. Incidentally, in FIG. 1, the primary transfer high-voltage source D1 is connected to only the primary transfer roller 6Y, but is similarly connected to each of other primary transfer rollers 6M, 6Y and 6C.

The drum cleaning device 7Y contacts the photosensitive drum 1Y and removes, from the photosensitive drum 1Y, the toner, paper powder, and the like which passed through the primary transfer portion T1 and which are deposited on the photosensitive drum 1Y.

<Intermediary Transfer Belt>

The intermediary transfer belt 40 is an intermediary transfer member rotatable in contact with the photosensitive drum 1Y. The intermediary transfer belt 40 is supported by being extended around a tension roller 41, an inner secondary transfer roller 42 and a driving roller 43, and is driven by the driving roller 43 and thus rotates in an arrow G direction in the figure at a rotational speed of 250-300 mm/sec, for example. The tension roller 41 stretches the intermediary transfer belt 40 with a certain tension.

The intermediary transfer belt 40 is an endless belt in which on a core metal as a substrate, in the order from the core metal side, a resin layer, an elastic layer and a surface layer are laminated. The resin layer uses, e.g., a resin material such as polyimide or polycarbonate, and is formed in a thickness of 70-100 μm. The elastic layer uses, e.g., an elastic material such as urethane rubber or chloroprene rubber, and is formed in a thickness of 120-180 μm. The surface layer requires a small toner depositing force for facilitating transfer of the toner from the intermediary transfer belt 40 onto the recording material P at the secondary transfer portion T2. For that reason, the surface layer uses, e.g., one species of resin materials such as polyurethane, polyester and epoxy resin, or two or more species of elastic materials such as an elastic material rubber, elastomer and butyl rubber. Further, in order to enhance a lubricating property by decreasing surface energy, in the surface layer, one species or two or more species of, e.g., powder or particles of a fluorine-containing resin or the like, or powder or particles different in particle size, are dispersed. The surface layer is formed in a thickness of 5-10 μm. Incidentally, the intermediary transfer belt 40 is adjusted so that a volume resistivity is, e.g., $10^{9}\Omega\cdot cm$.

The four color toner images transferred onto the intermediary transfer belt 40 are conveyed to the secondary transferring portion T2, and are secondary-transferred together onto the recording material P. An intermediary transfer belt cleaning device 45 is a cleaning blade which contacts the intermediary transfer belt 40 and which is capable of removing, from the intermediary transfer belt (intermediary transfer member), a residual toner or the like deposited on the intermediary transfer belt 40 after the secondary transfer. The intermediary transfer belt cleaning device 45 is, e.g., the cleaning blade which is contacted to the intermediary transfer belt 40 counterdirectionally with respect to the rotational direction (arrow G direction in the figure) of the intermediary transfer belt 40, and which is capable of removing the toner or the like from the intermediary transfer belt 40.

<Secondary Transfer Belt Unit>

A secondary transfer belt unit 56 causes the secondary transfer belt 12 as a rotatable secondary transfer memory to a pass through the secondary transfer portion T2 by causing the secondary transfer belt 12 to carry the recording material P. Using the secondary transfer belt 12, after the secondary transfer of the toner image at the secondary transfer portion T2, separation of the recording material P from the intermediary transfer belt 40 is facilitated.

The secondary transfer belt unit 56 includes the secondary transfer belt 12, an outer secondary transfer roller 10, a separation roller 21, a tension roller 22 and a driving roller 23. The secondary transfer belt 12 forms the secondary transfer portion T2 is contact with the intermediary transfer belt 40. A transfer electric field generates at the secondary transfer portion T2, so that the toner image carried on the intermediary transfer belt 40 is transferred onto the recording material P. Further, in this embodiment, a band-shaped supplying toner image (hereinafter referred to as a toner band) to be carried on the intermediary transfer belt 40 is transferred onto the secondary transfer belt 12.

The secondary transfer belt 12 is formed in an endless belt shape by using a high-resistant resin material and is stretched by the outer secondary transfer roller 10, the separation roller 21, the tension roller 22 and the driving roller 23. The secondary transfer belt 12 rotates in an arrow B direction in the figure at, e.g., 300 mm/sec in synchronism with the intermediary transfer belt 40, and feeds the recording material P to the fixing device 60 by causing the recording material P fed by the registration roller pair 13 to pass through the secondary transfer portion T2. The secondary transfer belt 12 feeds the recording material P in close contact with the recording material P by being charged when the toner image carried on the intermediary transfer belt 40 is transferred onto the recording material P, while the secondary transfer belt 12 separates the recording material P, on which the toner image is transferred, from the intermediary transfer belt 40 and then feeds the recording material P toward the fixing device 60.

The secondary transfer belt 12 is the endless belt formed using a resin material, such as polyimide or polyamide, in which carbon black as an antistatic agent is contained in an appropriate amount. The secondary transfer belt 12 is adjusted so that a volume resistivity is $10^9$-$10^{14}$Ω·cm. Further, the secondary transfer belt 12 is formed in a thickness of 0.07-0.1 mm. Further, the secondary transfer belt 12 has a Young's modulus of not less than 100 MPa and less than 10 GPa as measured by a tensile testing method (JIS K 6301).

The outer secondary transfer roller 10 is press-contacted to the secondary transfer belt 12 toward the intermediary transfer belt 40 and the inner secondary transfer roller 42, and forms the secondary transfer portion T2 between the intermediary transfer belt 40 and the secondary transfer belt 12. To the outer secondary transfer roller 10, a secondary transfer high-voltage source 11 capable of variably changing a bias voltage is attached. In the secondary transfer high-voltage source 11, the bias voltage is subjected to constant-current control so that a transfer current of +40-+60 μA flows. The transfer electric field is generated at the secondary transfer portion T2 by applying a bias voltage (secondary transfer voltage) of the positive polarity opposite to the charge polarity of the toner from the secondary transfer high-voltage source to the outer secondary transfer roller 10 while connecting the inner secondary transfer roller 42 to the grounding potential (0 V). In response to this transfer electric field, the negative(-polarity) toner images of yellow, magenta, cyan and black carried on the intermediary transfer belt 40 are secondary-transferred onto the recording material P altogether. Further, in this embodiment, the toner band is secondary-transferred from the intermediary transfer belt 40 onto the secondary transfer belt 12.

The outer secondary transfer roller 10 is formed by laminating an elastic layer of an ion-conductive foamed rubber (NBR rubber) on a core metal as a substrate. The outer secondary transfer roller 10 is formed in an outer diameter of, e.g., 24 mm. The elastic layer is 6.0-12.0 μm in surface roughness Rz and is about 30-40 in Asker-C hardness. Further, the elastic layer is $10^5$-$10^7$ Ω in electrical resistance value as measured under application of a voltage of 2 kV in a normal temperature/normal humidity (N/N) environment (23° C./50% RH).

The separation roller 21 separates the recording material P from the secondary transfer belt 12 at a position downstream of the secondary transfer portion T2 with respect to the rotational direction of the secondary transfer belt 21. Specifically, after the recording material P on the secondary transfer belt 12 reaches the separation roller 21, the recording material P is curvature-separated from the secondary transfer belt 12 by a curved surface of the secondary transfer belt 12 along a peripheral surface of the separation roller 21.

The driving roller 23 is connected to an unshown driving motor and is rotated in an arrow B direction in the figure by driving the secondary transfer belt 12. The tension roller 22 includes an unshown urging (pressing) spring and urges the secondary transfer belt 12 from an inside toward an outside by an urging force of this urging spring, so that a predetermined tension is applied to the secondary transfer belt 12.

The recording material P curvature-separated from the secondary transfer belt 12 is conveyed by a conveying belt 61 and sent into the fixing device 60. The recording material P on which the toner image is fixed by the fixing device 60 is discharged to an outside of the image forming apparatus 100. However, a circumstance where the recording material P is conveyed after the fixation of the toner images in a one (single)-sided printing mode in which an image is formed on only a first surface (front surface) of the recording material P, is different from a circumstance where the recording material P is conveyed after the fixation of the toner images in a double (two)-sided printing mode in which an image is formed on both surfaces of the recording material P.

In the one-sided printing mode, the recording material P which passed through the fixing device 60 is discharged to an outside of the image forming apparatus as-is, through a discharging roller pair 33. On the other hand, in the double-sided printing mode, the recording material P on which the toner images are transferred passes through a reversal feeding pass 34 and a feeding pass 35 for double-sided printing which are used as feeding portions, and then is fed again to the secondary transfer portion T2 so that the second surface (back surface) which is the opposite surface from the first surface is an image forming surface, i.e., so that the recording material P is turned upside down. Specifically, the recording material P passed through the fixing device 60 is sent into the reversal feeding pass 34 and then is subjected to a switch-back operation, so that a leading end and a trailing end of the recording material P are changed to each other and then the recording material P is fed to the feeding pass 35 for the double-sided printing. The feeding pass 35 for the double-sided printing sends the recording material P to the secondary transferring portion T2 again by merging the recording material P with the registration roller pair 13. In this case, the recording material P is, after the toner image is secondary-transferred onto also the second surface (back surface) and is fixed thereon, discharged to the outside of the image forming apparatus through the discharging roller pair 33. Incidentally, the reversal feeding path 34 and the feeding pass 35 for the double-sided printing are capable of accommodating a plurality of recording materials P and are capable of simultaneously feeding the recording materials P.

A cleaning blade 90 as a cleaning means is, e.g., a rubber blade formed of an urethane rubber which contacts the secondary transfer belt 12 and which is capable of scraping the toner or the like which is deposited on the secondary transfer belt 12, off the secondary transfer belt 12 (rotatable secondary transfer member). The cleaning blade 90 is contacted to the secondary transfer belt 12 counterdirectionally with respect to a rotational direction (arrow C direction in the figure) of the secondary transfer belt 12 and scrapes the toner or the like off the secondary transfer belt 12. The toner or the like scraped off the secondary transfer belt 12 is discharged into an unshown collecting container.

<Two-Component Developer>

In the developing device 5Y, the developer is, e.g., a two-component developer containing a toner (non-magnetic) having a negative chargeability and a carrier having a positive chargeability. The toner includes colored resin particles containing a binder resin, a colorant and another additive as desired, and an external additive such as colloidal silica fine powder. For example, the toner is formed of a polyester resin material having the negative chargeability and may preferably have an average particle size of 5 μm or more and 8 μm or less. In this embodiment, the toner of 7 μm in average particle size was used.

Further, in the toner, a wax for improving a parting property from the device 60 during the fixing of the toner image on the recording material P and for improving a toner fixing property is contained. As the wax, e.g., polyolefin wax, a long-chain hydrocarbon wax, dialkylketene wax, ester wax and amide wax are used. A melting point of the wax is ordinarily 40-160° C. and may preferably be 50-120° C., further preferably 60-90° C. When the melting point is within these ranges, a heat-resistant property of the toner is ensured, and even in the case where the fixing is effected at low temperature, image formation is effected without causing an image defect such as cold offset. Incidentally, a content of the wax in the toner may preferably be 3 wt. % to 30 wt. %.

As the carrier, e.g., surface-oxidized or unoxidized metals such as iron, nickel, cobalt, manganese, chromium, rare earth, alloys of the metals, or oxide ferrites may suitably be used, and a manufacturing method of magnetic particles of these materials is not particularly limited. The carrier has an average particle size of 20-50 μm, preferably 30-40 μm and has a volume resistivity of $10^7\Omega\cdot$cm or more, preferably $10^8\Omega\cdot$cm or more. In this embodiment, a carrier of 40 μm in volume-average particle size, $5\times10^8\Omega\cdot$cm in volume resistivity and 260 emu/cc in magnetization amount was used.

The volume-average particle sizes of the toner and the carrier were measured with the use of the following apparatus and method. As the measuring apparatus, a Coulter Counter TA-II (mfd. by Beckman Coulter Inc.), an interface (mfd. by Nikkaki-Bios K.K.) for outputting the number and volume average distributions of the developer, and a personal computer were used. As an electrolytic aqueous solution, 1% NaCl aqueous solution prepared by using a first class grade sodium chloride was used.

The measuring method is as follows. That is, 0.1 ml of a surfactant, preferably alkyl-benzene sulfonate, was added, as a dispersant, into 10-150 ml of above-mentioned electrolytic aqueous solution. Then, about 0.5-50 mg of a measurement sample was added to the above mixture. Then, the electrolytic aqueous solution in which the sample was suspended was subjected to dispersion by an ultrasonic dispersing device for about 1-3 minutes. Then, the distribution of the particles which were in a range of 2-40 μm in diameter was obtained with the use of the Coulter Counter TA-II fitted with a 100 μm aperture as an aperture. The volume-average particle size was obtained from the thus obtained volume-average distribution.

Further, the volume resistivity of the carrier was measured by the following method. Using a cell of the sandwich type which was 4 $cm^2$ in the area (size) of each of its measurement electrodes and which was 0.4 cm in the gap between the electrodes, the volume resistivity was measured by a method in which the carrier resistivity was obtained from an electric current which flowed through the circuit while 1 kg of weight was applied to one of the electrodes and a voltage E (V/cm) was applied between the two electrodes.

The above-described cleaning blade 90 is capable of scraping off not only the toner deposited on the secondary transfer belt 12 but also the wax deposited on the secondary transfer belt 12. However, different from the toner or the like, the wax has an adhesive property, and therefore, the scraped wax is liable to accumulate and deposit at an edge portion 90*a* of the cleaning blade 90, so that a deposition amount thereof increases with an increasing number of sheets (recording materials) subjected to the image formation. Further, when a height of the deposited wax (lump of the wax) reaches a height (level) in which the toner can pass through the cleaning blade 90, improper cleaning of the toner occurs, with the result that the image defect can be produced on the recording material P.

Therefore, in view of the above-described circumstances, in this embodiment, the toner is forcedly supplied to the cleaning blade 90 during continuous image formation, so that the scraped wax is prevented from depositing at the edge portion 90*a* of the cleaning blade 90.

<Controller>

As shown in FIG. 1, the image forming apparatus 100 is provided with a controller (control portion) 200 and an operating portion 201.

The controller 200 is, e.g., a CPU or the like, which controls various operations of the image forming apparatus 100, and includes a memory, such as a ROM and RAM. In the memory, various programs, data, etc., for controlling the image forming apparatus 100 are stored. The operating panel 201 receives execution start instructions of various programs, such as a continuous image forming job, by a user, various data inputs by the user, and the like, and is, e.g., an external terminal such as a scanner or a personal computer, or an operating panel or the like. In this embodiment, the user is capable of providing an instruction to perform an operation in a double-sided printing mode in which the image formation is effected on both surfaces of the recording material P and an operation in a single-sided printing mode in which the image formation is effected on only one surface of the recording material P, through the operating portion 201. Further, the user is capable of providing an instruction to perform an operation in a plural color mode in which toner images of a plurality of colors (multi-colors) can be formed by a combination of some of colors of yellow, magenta, cyan and black and an operation in a single color mode in which a toner image of only a single color such as black can be formed. Further, the user is capable of designating a size of the recording material P and a feeding direction (e.g., A3 short edge feeding, A4 long edge feeding) of the recording material P.

In the case where from the operating portion 201, a start instruction of the continuous image forming job in the operation in either one of the above-described printing modes is provided, the controller 200 executes an image forming process (program) stored in the memory on the basis of image data inputted from the operating portion 201. The controller 200 controls the image forming apparatus 100 on the basis of the execution of the image forming process.

Here, the continuous image forming job is performed in a period from start of image formation on the basis of a print signal for forming images continuously on a plurality of recording materials until the image forming operation is completed. Specifically, this period refers to a period from a pre-rotation (preparatory operation before the image formation) after receiving a print instruction signal to a postrotation (operation after the image formation), and is a period including an image forming period and sheet interval(s). Incidentally, for example, in the case where after one job, another job is inputted sequentially, these jobs are discriminated as one job as a whole.

FIG. 2 shows a flowchart of the image forming process executed by the controller 200. As shown in FIG. 2, the controller 200 discriminates whether or not the double-sided printing mode is instructed. In the case where the controller 200 discriminates that the single-sided printing mode is instructed (NO of S1), the controller 200 executes image forming control for forming the toner image on the first surface (front surface) of the recording material P (S2). Thereafter, the process by the controller 200 goes to a process of S6. Thus, in the case of the single-sided printing mode, a toner band (FIG. 3) described later is not formed on the secondary transfer belt 12.

In the case where the controller 200 discriminated that the double-sided printing mode is instructed (YES of S2), the controller 200 discriminates whether or not an objective surface (image forming surface) subjected to image forming control is the second surface (back surface) of the recording material P (S3). When the controller 200 discriminated that the image forming surface is not the second surface (NO of S3), the process jumps to a process of S2 and the controller 200 controls the image forming control for forming the toner image on the first surface of the recording material P (S2). Thus, in the case where the image forming control for the first surface of the recording material P is effected although the printing mode is the double-sided printing mode, the toner band is not formed on the secondary transfer belt 12.

On the other hand, in the case where the controller 200 discriminated that the image forming surface is the second surface (back surface) of the recording material P (YES of S3), the controller 200 executes toner band forming control for forming the toner band on the secondary transfer belt 12 (S4).

In this case, the controller 200 controls the image forming apparatus 100 and forms the toner band on the secondary transfer belt 12 in a sheet interval between a recording material P and a subsequent recording material P. As specifically described later, of regions (sheet intervals) each corresponding to an interval between consecutive two recording materials, the toner band is formed in at least either one of regions in front of and in the rear of the recording material having the second surface as the image forming surface. The controller 200 forms a yellow toner band highest in brightness among the colors by using the image forming portion PY, and then causes the intermediary transfer belt 40 to carry the formed yellow toner band. Then, the controller 200 controls the secondary transfer high-voltage source 11, and transfers the yellow toner band from the intermediary transfer belt 40 onto the secondary transfer belt 12. Thus, the yellow toner band is formed on the secondary transfer belt 12. The toner band is a solid image and is formed so that a length thereof with respect to a direction (widthwise direction) crossing the rotational direction of the secondary transfer belt 12 is a length of the cleaning blade 90 contacting the secondary transfer belt 12 with respect to a longitudinal direction. Further, the toner band is formed so that a length (toner band length) of the toner band with respect to the rotational direction of the intermediary transfer belt 40 is a predetermined length such as 5 mm or 15 mm.

FIG. 3 shows the toner bands formed on the secondary transfer belt 12. In FIG. 3, for easy understanding of the description, the toner bands formed on the secondary transfer belt 21 are shown in a time-series manner, and for convenience, positions of the recording materials P (where the toner images are to be formed) are shown. In FIG. 3, "1ST" represents the first surface (front surface) of the recording material P, and "2ND" represents the second surface (back surface) of the recording material P. The recording materials P do not exist in actuality, and are illustrated for showing that a region including a space corresponding to the recording material P is ensured as the sheet interval. The recording material P for the second surface has already been subjected to image formation of the toner image on the first surface, and therefore, the position of thereof is in a region where there is a possibility that the wax is deposited on the secondary transfer belt 12.

As shown in FIG. 3, a toner band 70 is formed on the secondary transfer belt 12 in a sheet interval (during non-sheet-passing portion) between consecutive two recording materials P. However, in this embodiment, the toner band 70 is formed immediately in front of the recording materials P. However, in this embodiment, the toner band 70 is formed immediately in front of the recording material P in a side downstream of the recording material P for the second surface (image formation) with respect to the rotational direction of the secondary transfer belt 12. The reason why the toner band is formed immediately in front of the recording material P is that when the toner is supplied excessively early and it takes much time for the wax to reach the cleaning blade 90, the toner supplied to the cleaning blade 90 is almost scraped off by the cleaning blade 90, with a lapse of time, so that the lump of wax is liable to be generated at the edge portion 90*a*. Therefore, the toner bond may desirably be formed immediately in front of the recording material P to the possible extent so that the toner reaches the cleaning blade 90 earlier than the wax.

Referring again to FIG. 2, the controller 200 executes the image forming control for forming the toner image on the second surface (back surface) of the recording material P (S5). Then, the controller 200 discriminates whether or not the continuous image forming job should be ended (S6). In the case where the controller 200 discriminated that the continuous image forming job should be ended (YES of S6), the controller 200 ends the image forming process. In the case where the controller 200 discriminated that the continuous image forming job should not be ended (NO of S6), the controller causes the process to be returned to the process of S1 and then repeats the processes of S1-S6.

The present inventors conducted an experiment under the following condition in order to check enablement or disablement of suppression of generation of the image defect by supplying the toner to the cleaning blade 90. The image was repetitively formed on A4-sized sheets under a condition in which a weight ratio (T/D) of the toner and the carrier in the developer during start of a continuous image forming job was 8% and in which an image ratio and an environment and the like were the same. In order to facilitate understanding of the influence by the wax, the image ratio was set at 25%. As the experiment, three experiments consisting of an experiment for performing the continuous image forming job while supplying the toner to the cleaning blade 90 in the operation in the double-sided printing mode, an experiment for performing the continuous image forming job without supplying the toner to the cleaning blade 90 in the operation in the double-sided printing mode, and an experiment for performing the continuous image forming toner in the operation in the single-sided printing mode were conducted. Incidentally, in the operation in the single-sided printing mode, when the image is formed on sheets which are the same in number as those in the operation in the double-sided printing mode, the number of times of passing of the recording materials P through the secondary transfer portion T2 is half of that in the case of the operation in the double-sided printing mode. For that reason, in the operation in the single-sided printing mode, the image was formed on the recording materials P in the number of sheets which is twice the number of sheets during the operation in the double-sided printing mode.

In the case where the continuous image forming job was performed without supplying the toner to the cleaning blade 90 in the operation in the double-sided printing mode, a stripe image defect generated on the recording material P at about 10,000 sheets. When the cause was diagnosed, it was confirmed that at a position where the stripe image defect generated, the toner was moved from a front surface side to a back surface side of the cleaning blade 90 (i.e., from an upstream side to a downstream side with respect to the rotational direction of the secondary transfer belt 12). When the edge portion 90*a* was observed in an enlarged state through a microscope, it turned out that the toner passed through the side of the deposited wax. When a height of the wax was measured, the height was about 20 μm. On the other hand, the average particle size of the toner was 7 μm. That is, at the edge portion 90*a*, the wax was deposited in a height sufficient to cause the passing of the toner through the side of the wax, so that the lump of the wax was generated.

On the other hand, in the case where the continuous image forming job was performed while supplying the toner to the cleaning blade 90 in the double-sided printing mode, even when the image was repetitively formed on 20,000 sheets of the recording materials P, the image defect did not generate on the recording materials P. Further, in the case where the continuous image forming job was performed in the operation in the single-sided printing mode, even when the image was repetitively formed on 40,000 sheets, the image defect did not generate on the recording materials P. After the image formation on 40,000 sheets of the recording materials P in the operation in the single-sided printing mode, when the edge portion 70*a* was observed in an enlarged state through a microscope, the wax was not deposited at the edge portion 90*a*. On the other hand, at the edge portion 90*a* after the image was formed on 20,000 sheets of the recording materials in the operation in the double-sided printing mode (using the toner bands), the wax somewhat existed but a measured height is 2 μm or less, and thus it was confirmed that the height of the wax was sufficiently smaller than the average particle size of 7 μm of the toner.

As described above, in this embodiment, the toner band 70 is formed immediately in front of the recording material P for the second surface (image formation) in the downstream side with respect to the rotational direction of the secondary transfer belt 12. When the toner band 70 is formed immediately in front of the recording material P, the toner reaches the edge portion 90*a* before the wax reaches the edge portion 90*a*. The toner functions as the lubricant by being sandwiched between the edge portion 90*a* and the secondary transfer belt 12, so that the wax which reached the edge portion 90*a* after the toner and which was scraped off by the edge portion 90*a* is passed through the edge portion 90*a* as-is. As a result, the wax is prevented from being sandwiched and maintained between the edge portion 90*a* and the secondary transfer belt 12 and does not readily form the lump of the wax, and therefore it is possible to avoid the generation of the image defect due to the lump of the wax.

Second Embodiment

Second Embodiment will be described using FIGS. 4-6. In this embodiment, a two-component developer containing, as a developer, a toner having a small average particle size. When the average particle size of the toner is small, a protrusion amount of the toner from 1-dot pixel is small, so that noise is not readily recognized by the user seeing the toner image formed on the recording material P. For that reason, the developer containing the toner having the small average particle size is used in, e.g., the case where the toner image high in image quality is intended to be formed on the recording material P. In First Embodiment, the developer containing the toner having the average particle size of 7 μm is used, and on the other hand, in this embodiment, the developer containing the toner having the average particle size of 5 μm is used.

Figure 4:
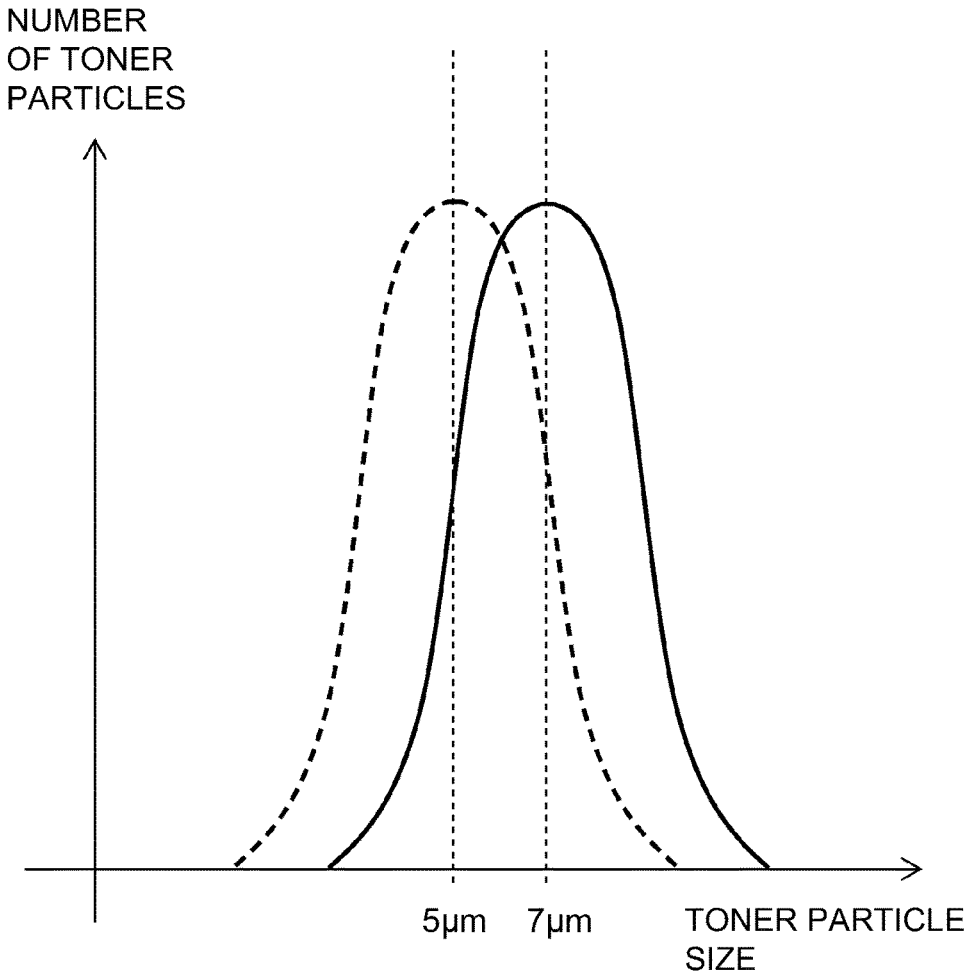
FIG. 4 is a graph showing a particle size distribution of a toner.

FIG. 4 is a graph showing a particle size distribution of the toner contained in the developer. As shown in FIG. 4, when the average particle size of the toner decreases, a proportion of the toner (the number of toner particles) having a small particle size increases in general. With a decreasing particle size of the toner, the toner is slight in amount, but is liable to pass through the cleaning blade 90. Therefore, when the toner having the small particle size is supplied to the cleaning blade 90, the wax likely to be sandwiched between the edge portion 90*a* and the secondary transfer belt 12 can be pushed out by the toner which passes through the cleaning blade 90 in a slight amount.

Figure 5:
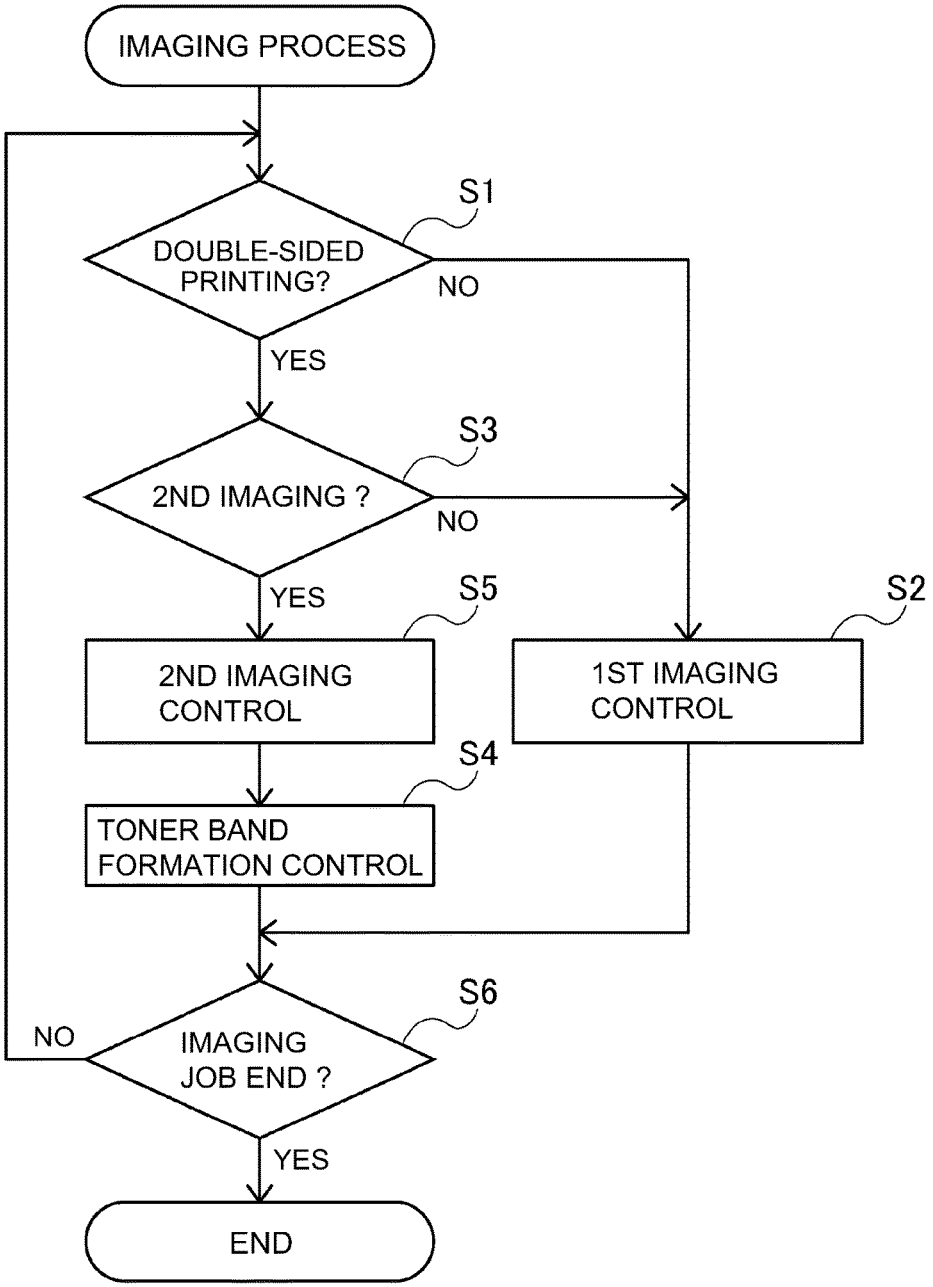
FIG. 5 is a flowchart showing an image forming process in Second Embodiment.

FIG. 5 is a flowchart of an image forming process in this embodiment. This image forming process is executed by the controller 200. The image forming process shown in FIG. 5 is only different from the image forming process shown in FIG. 2 in that the order of the toner band forming control (S4) and the image forming control (S5) are reversed, and therefore other processes (steps) will be omitted from description.

In the image forming process shown in FIG. 5, after the toner image is formed on the second surface of the recording material P (S5), the toner band is formed on the secondary transfer belt 12 (S4). In FIG. 6, toner bands formed on the secondary transfer belt 12 in the case where the image forming process in this embodiment is performed are shown.

Figure 6:
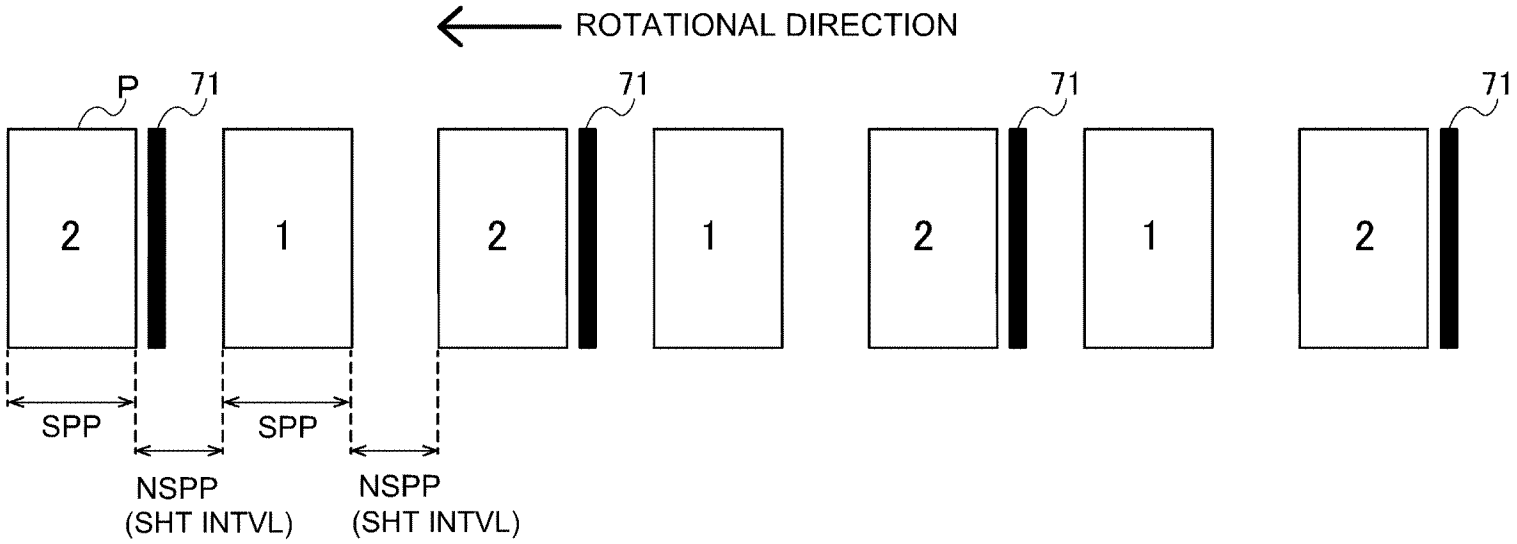
FIG. 6 is a schematic view for illustrating a toner band formed on Second Embodiment.

As shown in FIG. 6, a toner band 71 is formed in a sheet interval (during non-sheet-passing portion) between a recording material P and a subsequent recording material P, but in this embodiment, the toner band 71 is formed immediately in the rear of the recording material P for the second surface in a side upstream of the recording material P with respect to the rotational direction of the secondary transfer belt 12. The toner band 71 is formed using the image forming portion PY similarly as in First Embodiment and is yellow which is highest in brightness among the respective colors.

The present inventors conducted an experiment in order to check enablement or disablement of suppression of generation of the image defect by supplying the toner to the cleaning blade 90. An experimental condition is the same as that in First Embodiment. In this embodiment, an experiment for performing the continuous image forming job while supplying the toner to the cleaning blade 90 in the operation in the double-sided printing mode and an experiment for performing the continuous image forming job without supplying the toner to the cleaning blade 90 in the operation in the double-sided printing mode were conducted.

In the case where the continuous image forming job was performed without supplying the toner to the cleaning blade 90 in the operation in the double-sided printing mode, a stripe image defect generated on the recording material P at about 10,000 sheets. The cause was the same as the cause in First Embodiment. That is, it was confirmed that at a position where the stripe image defect generated, the toner was moved from a front surface side to a back surface side of the cleaning blade 90 (i.e., from an upstream side to a downstream side with respect to the rotational direction of the secondary transfer belt 12).

On the other hand, in the case where the continuous image forming job was performed while supplying the toner to the cleaning blade 90 in the double-sided printing mode, even when the image was repetitively formed on 20,000 sheets of the recording materials P, the image defect did not occur on the recording materials P. When the edge portion 70*a* was observed in an enlarged state through a microscope, the wax somewhat accumulated but a measured height is 2 μm or less. It was confirmed that the lump of the wax was sufficiently smaller than the average particle size of 5 μm of the toner in the case where the developer containing the toner having the small average particle size was used.

As described above, in this embodiment, the toner band 71 is formed immediately in the rear of the recording material P for the second surface (image formation) in the upstream side with respect to the rotational direction of the secondary transfer belt 12. When the toner band 71 is formed immediately in rear of the recording material P, the toner is supplied to the edge portion 90*a* immediately after the wax reaches the edge portion 90*a*. Then, the wax sandwiched between the edge portion 90*a* and the secondary transfer belt 12 is easily pushed by the toner toward the downstream side with respect to the rotational direction of the intermediary transfer belt 12. As a result, the wax is prevented from being sandwiched and maintained between the edge portion 90*a* and the secondary transfer belt 12 and does not readily form the lump of the wax, and therefore it is possible to avoid generation of the image defect due to the lump of the wax.

Third Embodiment

Third Embodiment will be described using FIGS. 7 and 8. Third Embodiment is employed in, e.g., the case where the number of sheets of the recording materials subjected to image formation per unit time is increased in order to further enhance productivity. That is, in the case where the number of sheets subjected to image formation per unit time is increased, with an increasing image forming speed of the image forming portions PY to PK, there is a need to increase rotational speeds of the intermediary transfer belt 40 and the secondary transfer belt 12. For example, the rotational speed of the secondary transfer belt 12 is changed from 300 mm/sec to 400 mm/sec. Thus, when the image forming speed is increased, the recording material P is fed at a higher speed. Correspondingly, in the above-described cases of First Embodiment and Second Embodiment, the amount of the toner becomes smaller than the amount of the wax reaching the cleaning blade 90, so that the amount of the wax deposited on the secondary transfer belt 12 per unit time gradually increases. When the amount of the wax deposited on the secondary transfer belt 12 per unit time increases, the lump of the wax is liable to generate at the edge portion 90*a*. In view of this point, in this embodiment, two toner bands 70 and 71 are formed immediately in front of the recording material P for the second surface in the downstream side of the recording material P and immediately in the rear of the recording material P for the second surface in the upstream side of the recording material P, respectively, with respect to the rotational direction of the secondary transfer belt 12.

Figure 7:
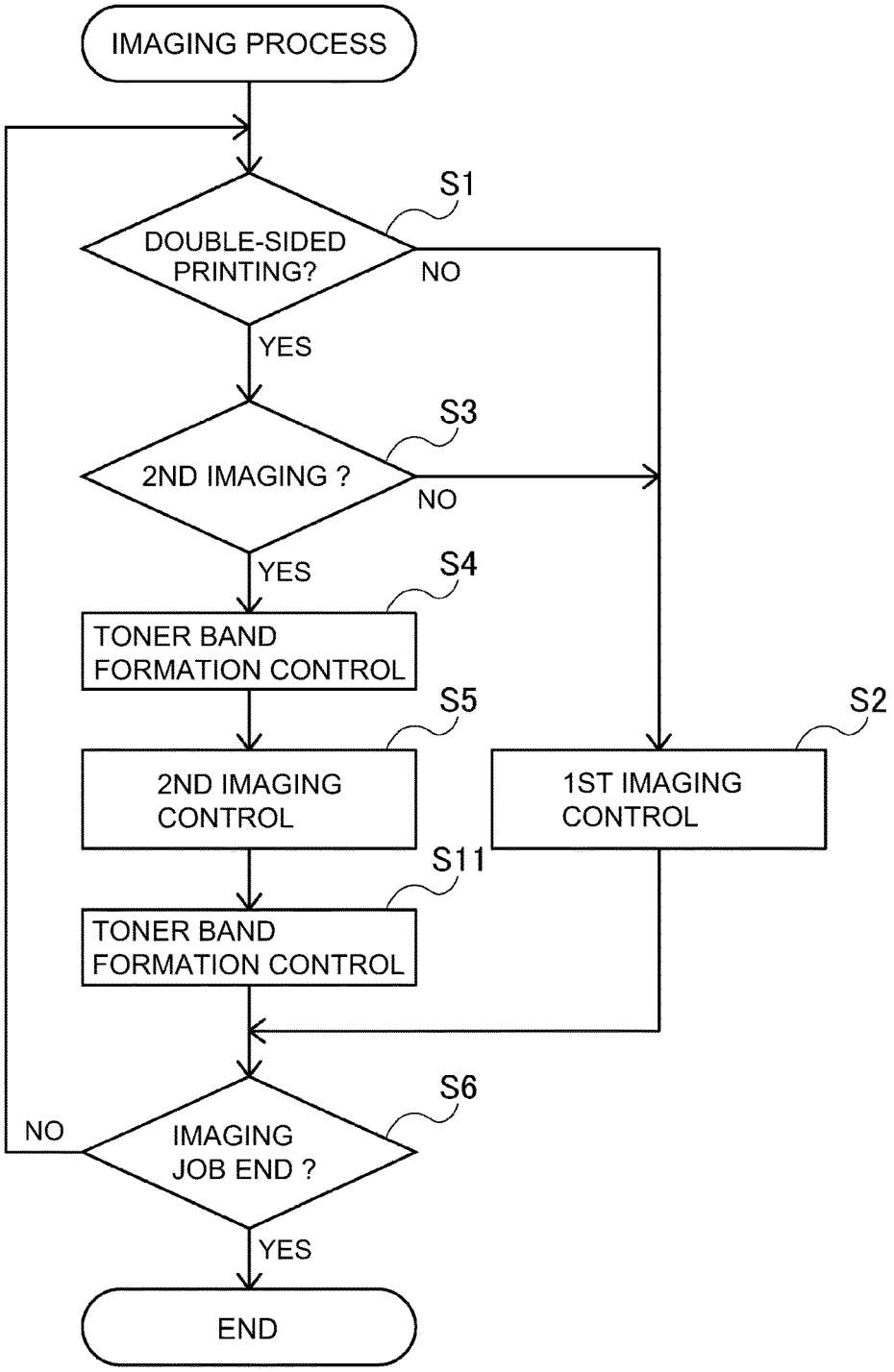
FIG. 7 is a flowchart showing an image forming process in Third Embodiment.

FIG. 7 is a flowchart of an image forming process in this embodiment. This image forming process is executed by the controller 200. The image forming process shown in FIG. 7 is only different from the image forming process shown in FIG. 2 in that a toner band forming control (S11) is added after the steps of the toner band forming control (S4) and the image forming control (S5), and therefore other processes (steps) will be omitted from description.

In the image forming process shown in FIG. 7, although the toner band is formed immediately in front of the recording material P for the second surface (S4), the toner band 71 is formed immediately in the rear of the recording material P for the second surface (S11) after the toner image is formed (S5). That is, the toner bands 70 and 71 are formed immediately in front of and immediately in the rear of the recording material P for the second surface, respectively. In FIG. 8, toner bands formed on the secondary transfer belt 12 in the case where the image forming process in this embodiment is performed are shown.

Figure 8:
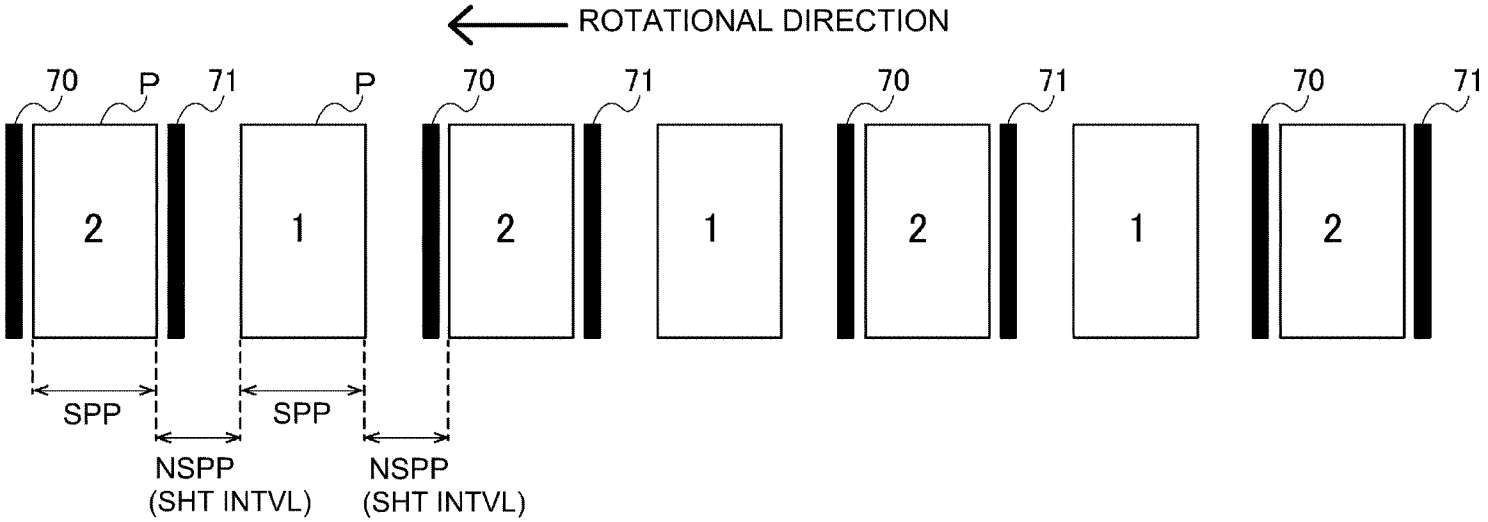
FIG. 8 is a schematic view for illustrating a toner band formed in third Embodiment.

As shown in FIG. 8, the toner bands 71 and 72 are formed in sheet intervals between recording materials P. However, the toner band 70 is formed immediately in front of the recording material P for the second surface in the downstream side of the recording material P with respect to the rotational direction of the secondary transfer belt 12, and the toner band 71 is formed immediately in the rear of the same recording material P for the second surface in the upstream side of the recording material P with respect to the rotational direction of the secondary transfer belt 12. The toner bands 71 and 72 are formed using the image forming portion PY similarly as in First Embodiment and are yellow which is highest in brightness among the respective colors.

The present inventors conducted an experiment in order to check enablement or disablement of suppression of generation of the image defect by supplying the toner to the cleaning blade 90. An experimental condition is the same as that in First Embodiment except that the secondary transfer belt 12 was rotated at the rotational speed of 400 mm/sec higher than that in the case of First Embodiment. In this embodiment, an experiment for performing the continuous image forming job while supplying the toner to the cleaning blade 90 in the operation in the double-sided printing mode and an experiment for performing the continuous image forming job without supplying the toner to the cleaning blade 90 in the operation in the double-sided printing mode were conducted.

In the case where the continuous image forming job was performed without supplying the toner to the cleaning blade 90 in the operation in the double-sided printing mode, the stripe image defect generated on the recording material P at about 6,000 sheets. Further, even in the case of First Embodiment in which the toner band 70 is formed on the secondary transfer belt 12 immediately in front of the recording material P, on which the toner image is to be formed, to the possible extent, the stripe image defect occurred on the recording material P at about 14,000 sheets. It was confirmed that at positions where these stripe image defects generated, the toners were moved from a front surface side to a back surface side of the cleaning blade 90 (i.e., from an upstream side to a downstream side with respect to the rotational direction of the secondary transfer belt 12).

On the other hand, in the case where the continuous image forming job was performed while supplying the toner to the cleaning blade 90 in the double-sided printing mode, even when the image was repetitively formed on 20,000 sheets of the recording materials P, the image defect did not generate on the recording materials P. When the edge portion 70*a* was observed in an enlarged state through a microscope, the wax somewhat accumulated but a measured height is 3 μm or less. It was confirmed that the lump of the wax was sufficiently smaller than the average particle size of 7 μm of the toner.

As described above, in this embodiment, the toner band 70 is formed immediately in front of the recording material P for the second surface (image formation) in the downstream side with respect to the rotational direction of the secondary transfer belt 12, and the toner band 71 is formed immediately in rear of the recording material P, for the second surface in the upstream side with respect to the rotational direction of the secondary transfer belt 12. The toner band 70 formed immediately in front of the recording material P is supplied to the edge portion 90*a* before the wax reaches the edge portion 90*a*. The toner band 71 formed immediately in the rear of the recording material P is supplied to the edge portion 90*a* immediately after the wax reaches the edge portion 90*a*. That is, the toners are supplied to the cleaning blade 90 before and after the wax reaches the edge portion 90*a*. As a result, the toner can pass through the wax scraped by the edge portion 90*a*, and even when the scraped wax is sandwiched between the edge portion 90*a* and the secondary transfer belt 12, the wax can be pushed out. By this synergistic effect, the wax does not readily generate, and therefore it is possible to prevent the image defect due to the lump of the wax.

In the above-described First to Third Embodiments, the toner bands 70 and 71 were formed by the toner of yellow highest in brightness. This is because by forming the toner bands with the toner of yellow highest in brightness among yellow, magenta, cyan and black, even when the recording material P is somewhat contaminated by scattering of the toner, the contamination is less conspicuous than other colors. Further, as shown in FIG. 1, the image forming portion PY for forming the yellow toner image is disposed in a most-upstream side among the image forming portions PY, PM, PC and PK with respect to the rotational direction of the intermediary transfer belt 40. For that reason, the yellow toner image transferred on the intermediary transfer belt 40 passes through the primary transfer portions T1 formed between the intermediary transfer belt 40 and other image forming portions PM, PC and PK. To these primary transfer portions T1, a bias voltage for transferring the toner images onto the intermediary transfer belt 40 is applied. For that reason, when a toner charge amount increases, a depositing force of the toner on the intermediary transfer belt 40 increases, so that the toner does not readily scatter from the toner image. The toner image having a largest toner charge amount is the yellow toner image which passes through the primary transfer portions T1 for times in total. That is, a toner scattering lowering effect is highest for the yellow toner image formed by the image forming portion PY disposed in the most-upstream side with respect to the rotational direction of the intermediary transfer belt 40, and therefore also the toner bands are formed with the yellow toner.

Fourth Embodiment

The image forming apparatus 100 is capable of forming not only the multi-color image but also the black (single color) image. Therefore, in the case where the operation in the black (single color) mode for forming the black (single color) image is instructed by the user, a black toner band is formed using the image forming portion PK. Description will be made below. Incidentally, in this embodiment, the case where two toner bands 70 and 71 are formed immediately in front of the recording material P for the second surface in the downstream side of the recording material P and immediately in the rear of the recording material P for the second surface in the upstream side of the recording material P, respectively, with respect to the rotational direction of the secondary transfer belt 12 will be described as an example.

Figure 9:
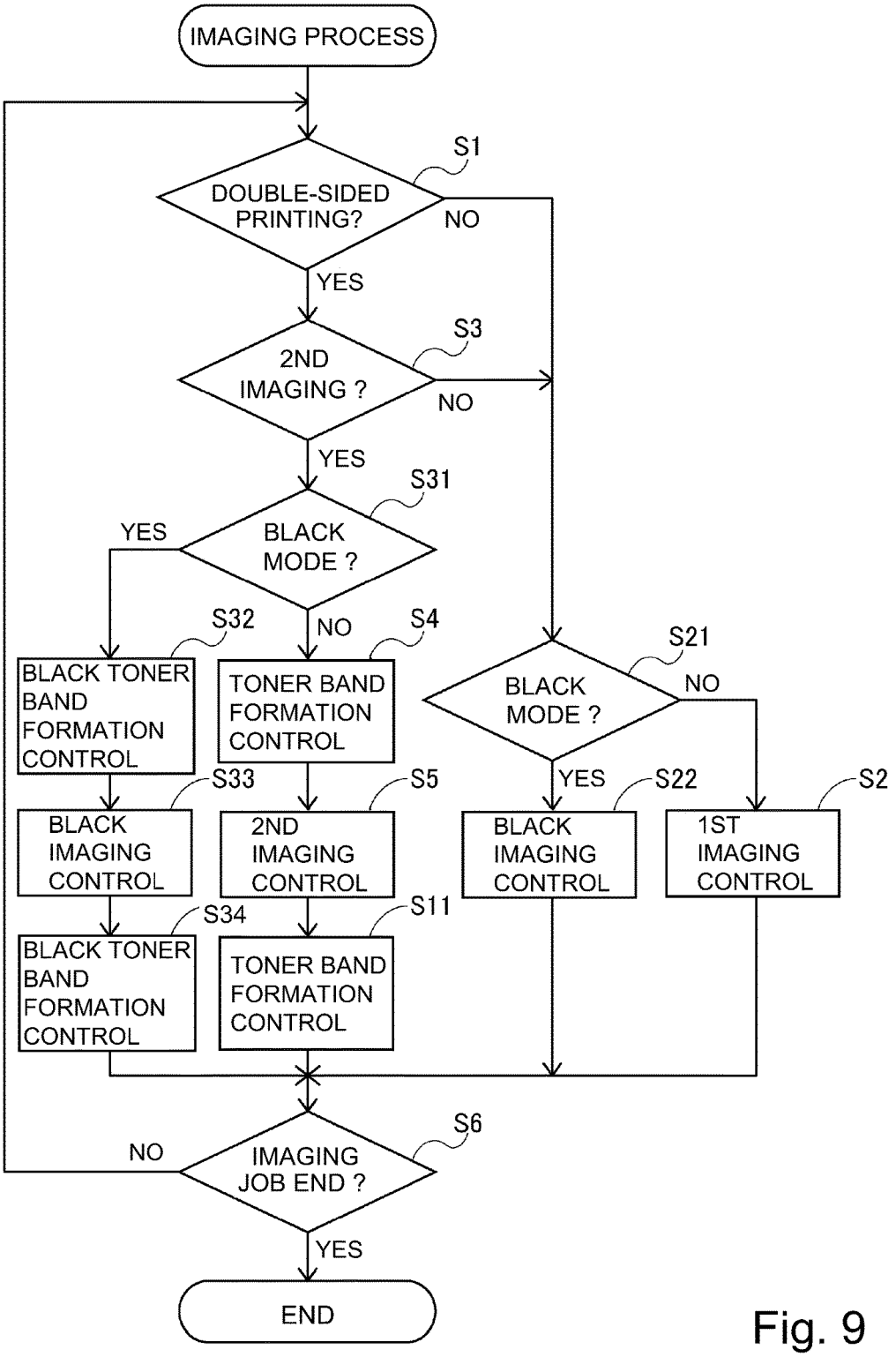
FIG. 9 is a flowchart showing an image forming process in Fourth Embodiment.

FIG. 9 is a flowchart of an image forming process in this embodiment. This image forming process is executed by the controller 200. Incidentally, the image forming process shown in FIG. 9, steps which are the same as those in the image forming process shown in Third Embodiment (FIG. 7) are represented by the same reference numerals or symbols and will be omitted from detailed description.

As shown in FIG. 9, during an operation in the single-sided printing mode (NO of S1), the controller 200 executes image forming control for forming the toner image on the first surface (front surface) (S2, S22), but discriminates whether or not an operation in the black (single color) mode is instructed by the user in advance of the image forming control (S21). In the case where the operation in the black mode is instructed by the user (YES of S21), the controller 200 forms the toner image of only black using only the image forming portion PK (S22). In the case where the operation in the plural color mode is instructed by the user (NO of S21), the controller 200 is capable of forming the toner images on the first surfaces with the toners of the plurality of colors using the image forming portions PY to PK.

In the case where the controller 200 discriminates that the image forming surface is not the second surface of the recording material P (NO of S3), the controller 200 jumps to the process of S21 and forms the toner image on the first surface of the recording material P in the above-described manner (S2, S22). In the case where the controller 200 discriminate that the image forming surface is the second surface of the recording material P (YES of S3), the controller 200 executes the toner band forming control for forming the toner band on the secondary transfer belt 12, but discriminates whether or not the operation in the black mode is instructed by the user in advance of the toner band forming control (S31).

In the case where the operation in the black mode is instructed by the user (YES of S3), the controller 200 forms the toner band of black on the secondary transfer belt 12 in a sheet interval between a recording material P and a subsequent recording material P (S32). In this case, the black toner band is formed immediately in front of the recording material P for the second surface (image formation). Then, the controller 200 executes image forming control for forming a black toner image on the second surface of the recording material P (S33). Further, the controller forms the black toner band on the secondary transfer belt 12 in the sheet interval between the recording material P and the subsequent recording material P (S34). In this case, the black toner band is formed immediately in the rear of the recording material P for the second surface. In the case where the operation in the plural color mode is instructed by the user (NO of S31), the controller 200 forms yellow toner bands immediately in front of and immediately in the rear of the recording material P for the second surface, respectively (S4, S11).

In the case where the image forming process shown in FIG. 9 is performed, the black toner bands 70 and 71 are formed in the case of the operation in the black mode, and the yellow toner bands 70 and 71 are formed in the case of the plural color mode (FIG. 8). The toner band 70 is formed immediately in front of the recording material P for the second surface, and the toner band 71 is formed immediately in the rear of the recording material for the second surface.

Between the operations in the plural color mode and the black (single color) mode, an amount of the toner(s) supplied to the cleaning blade 90 may be changed. That is, in the case where the continuous image forming job is performed, in the operation in the plural color mode the waxes in the amount corresponding to those for the four colors are capable of being deposited on the secondary transfer belt 12, and in the operation in the black mode, the wax in the amount corresponding to that for the one color (black) is capable of being deposited on the secondary transfer belt 12. For that reason, in the operation in the plural color mode, in order to prevent generation of the lump of the wax, compared with the operation in the black mode, there is a need to supply the toner in the amount which is four times the amount in the operation in the black mode. For example, the toner bands have the same toner band length, there is a need to supply the toner in a toner deposition amount which is four times the toner deposition amount in the operation in the black mode. For that reason, in the operation in the plural color mode, compared with the operation in the black mode, the toner bands are formed in the toner deposition amount larger than the toner deposition amount in the operation in the black mode. In this embodiment, a maximum toner deposition amount in the operation in the plural color mode was set at 300% (as a maximum value) in the case where a maximum toner deposition amount in the operation in the black mode was 100%. For that reason, also the toner deposition amount of the toner band in the operation in the plural color mode may preferably be 3 times the toner deposition amount in the operation in the black mode.

The present inventors conducted an experiment in order to check enablement or disablement of suppression of generation of the image defect by supplying the toner to the cleaning blade 90. An experimental condition is the same as that in First Embodiment except that the secondary transfer belt 12 was rotated at the rotational speed of 400 mm/sec. In this embodiment, an experiment for performing the continuous image forming job while supplying the toner to the cleaning blade 90 in the operation in the double-sided printing mode in each of the operation in the plural color mode and the operation in the black mode was performed.

First, an experimental result of the operation in the plural color mode will be described. In this experiment, the continuous image forming job was performed in each of the case where the yellow toner band is formed, the case where the black toner band was formed in the same toner deposition amount as that of the yellow toner band and the case where the black toner band was formed in the toner deposition amount as that of the yellow toner band and the case where the black toner band was formed in the toner deposition amount which is ⅓ of the toner deposition amount of the yellow toner band.

In the case where the yellow toner band was formed and in the case where the black toner band was formed in the same toner deposition amount as that of the yellow toner band, the image defect did not generate although the image was repetitively formed on 20,000 sheets of the recording materials P. When the edge portion was observed in an enlarged state through a microscope, it was confirmed that the wax somewhat accumulated but a height thereof was 3 μm or less and was sufficiently smaller than the average particle size 7 μm of the toner. However, in the case where the black toner band was formed in the same toner deposition amount as that of the yellow toner band, when the image was formed on 20,000 sheets of the recording material P, it was confirmed that the recording material P was contaminated at an edge portion (side surface portion) with the toner. On the other hand, in the case where the yellow toner band was formed, no contamination with the toner at the edge portion of the recording material P was observed.

In the case where the black toner band was formed in the toner deposition amount which was ⅓ of that of the yellow toner band, the stripe image defect occurred on the recording material P at about 6,000 sheets. At a position where the stripe image defect generated, it was confirmed that the toner was moved from the front surface side to the rear surface side (from the upstream side to the downstream side of the secondary transfer belt 12) of the cleaning blade 90. When the edge portion 90*a* was observed in an enlarged state through the microscope, it turned out that the toner passed through the side of the deposited wax. When the height of the wax was measured, the height was about 20 μm. The above-described particle size of the toner was 7 μm, and therefore at the edge portion 90*a*, the wax was deposited in a height sufficient for the toner to pass through the side thereof, and the lump of the wax was generated.

Next, an experimental result of the operation in the black mode will be described. In this experiment, the continuous image forming job was performed in each of the case where the black toner band was formed in the same toner deposition amount as that of the yellow toner band in the operation in the plural color mode and the case where the black toner band was formed in the toner deposition amount as that of the yellow toner band and the case where the black toner band was formed in the toner deposition amount which is ⅓ of the toner deposition amount of the yellow toner band.

In the case where the black toner band was formed in the same toner deposition amount as that of the yellow toner band in the operation in the plural color mode, the image defect did not generate although the image was repetitively formed on 20,000 sheets of the recording materials P. When the edge portion was observed in an enlarged state through a microscope, it was confirmed that the wax somewhat accumulated but a height thereof was 3 μm or less and was sufficiently smaller than the average particle size 7 μm of the toner. However, when the image was formed on 20,000 sheets of the recording material P, it was confirmed that the recording material P was contaminated at an edge portion (side surface portion) with the toner. On the other hand, in the case where the yellow toner band was formed in the toner deposition amount which was ⅓ of the toner deposition amount of the yellow toner band, no contamination with the toner at the edge portion of the recording material P could not be observed. This is because when the black toner band is formed in the operation in the black mode in the same toner deposition amount as the toner deposition amount of the yellow toner band in the operation in the plural color mode, the toner in an excessive amount is supplied and toner scattering generates and thereby to cause the edge portion contamination with the toner. On the other hand, when the black toner band is formed in the toner deposition amount which is ⅓ of the toner deposition amount of the yellow toner band, it is possible to effect the image formation without generating not only the image defect but also the edge portion contamination with the toner.

As described above, during execution of the operation in the black mode, the toner band may be formed in the toner deposition amount smaller than that during execution of the operation in the plural color mode, and therefore it is possible to suppress the generation of the image defect due to the lump of the wax while suppressing toner consumption. Further, the edge portion contamination of the recording material P with the toner due to the toner scattering does not readily generate. Further, in the operation in the black mode, it is only required that the toner band is formed by operating the image forming portion PK, so that the image forming portion PY to PC other than the image forming portion PK are not required to be operated expressly, so that a lifetime of the image forming apparatus can be prolonged.

In the above-described First to Fourth Embodiments, the generation of the image defect due to the lump of the wax is suppressed by forcedly supplying the toner to the edge portion 90*a* of the cleaning blade 90 via the secondary transfer belt 12. Therefore, the toner consumption is liable to increase. For this reason, there is a need to take countermeasures to suppress the toner consumption. In order to suppress the toner consumption, for example, a method of adjusting a toner formation width of the toner band and a method of adjusting the toner deposition amount of the toner band would be considered. In the following, an embodiment capable of suppressing the toner consumption will be described. For easy understanding of explanation, the case where the toner band 70 is formed immediately in front of the recording material P for the second surface will be described as an example, but the present invention is not limited thereto. That is, the present invention is also applicable to the case where the toner band 70 is formed immediately in the rear of the recording material P for the second surface and the case where the toner band 70 is formed before and after the recording material P for the second surface.

Figure 10:
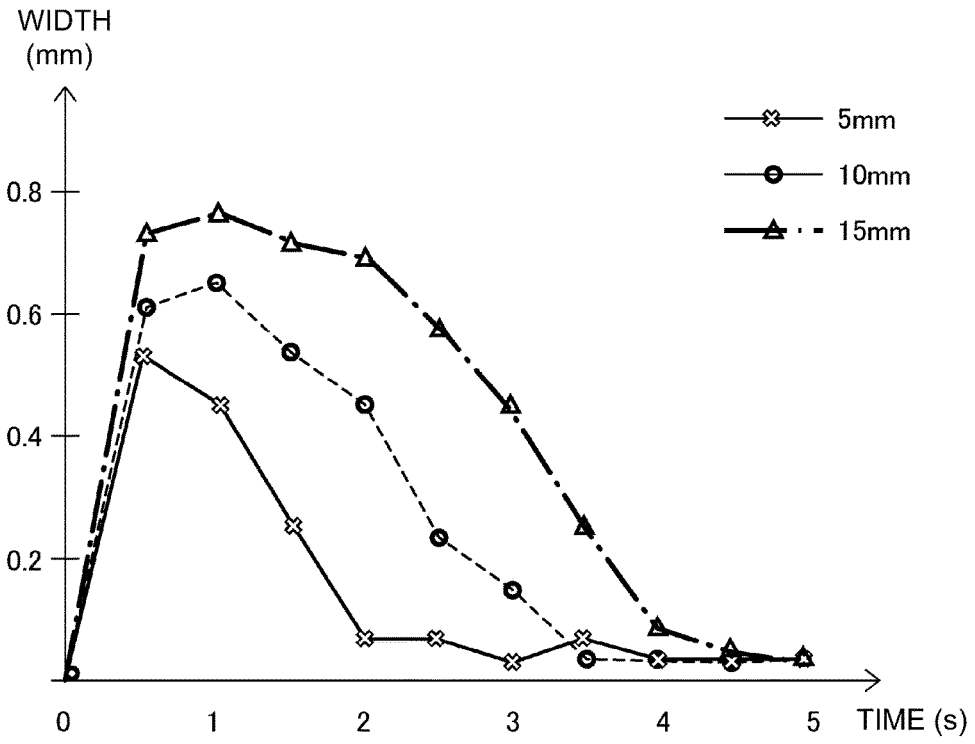
FIG. 10 is a graph showing a relationship between a toner band length and a time progression of a toner amount at an edge portion.

FIG. 10 shows a relationship between time progression of the toner amount of the toner accumulating at the edge portion 90*a* and the toner supplied to the cleaning blade 90. As an index of the toner amount, the image forming apparatus during the image formation was once stopped at predetermined timing (every 0.5 sec in this embodiment) and the cleaning blade 90 was removed, and then a width (residual toner width) of the toner remaining on the secondary transfer belt 12 was measured. The toner bands were formed in toner band lengths of 5 mm, 10 mm and 15 mm in the form of a solid image having the toner deposition amount of 50% with the yellow toner over an entire region of the cleaning blade 90 with respect to the longitudinal direction.

As can be understood from FIG. 10, at the time immediately after the toner supply (after 0.5 sec), the toner in a sufficient amount accumulates at the edge portion 90*a*, but the residual toner width gradually decreases with a laps of time. Further, when the toner band length of the toner band is increased from 5 mm to 15 mm, for example, the time is prolonged until the residual toner width is unchanged.

The present inventors conducted an experiment for checking generation or non-generation of the image defect in the case where an average image ratio was changed. In the experiment, a weight ratio (T/D) of the toner and the carrier in the developer at the time of start of the continuous image forming job was 8 & and the same condition such as an environment was employed, and on the other hand, the average image ratio was changed and the image was repetitively formed on 2,000 A3-size sheets in the operation in the double-sided printing mode. Here, the average image ratio is an average of ratios (image ratios or print ratios) each of an image area of the toner image formed on the first surface to an area of an entire region of each of the plurality of recording materials P.

An experimental result in the case where the toner band was not formed is shown in Table 1. In Table 1, the height of the wax deposited on the edge portion 90*a* and whether or not the stripe image defect generated on the recording material P are shown every average image ratio. The case where the stripe image defect generated is represented by "x".

TABLE 1

| AIR*1 (%) | Wax height (mm) | Image |
|---|---|---|
| 100 | 65 | x |
| 75 | 20 | x |
| 50 | 15 | x |
| 25 | 2 | ○ |
| 10 | 2 | ○ |

*1"AIR" is the average image ratio.

As can be understood from Table 1, in the case where the average image ratio was 50 or more, the stripe image defect occurred. When the cause thereof was diagnosed, it was confirmed that at the position where the stripe image defect occurred, the toner was moved from the front surface side to the rear surface side of the cleaning blade 90 (from the upstream side to the downstream side of the secondary transfer belt 12). When the edge portion 90*a* was observed in an enlarged state through the microscope, it turned out that the toner passed through the side of the deposited wax. When the wax height was measured, the height was about 65 μm at the average image ratio of 100% and was about 20 μm at the average image ratio of 75%. The average particle size of the toner was 7 μm, and therefore at the edge portion 90*a* of the cleaning blade 90, the wax is deposited in a height sufficient for the toner to pass through the side of the wax and the lump of the wax generated.

An experimental result in the case where the toner band was formed is shown in Table 2. However, in this experiment, the toner band length was changed and the image formation was repetitively effected. Also in Table 2, the case where the stripe image defect generated was represented by "x".

TABLE 2

| AIR*1 (%) | TBL*2 (mm) | WH*3 (μm) | Image |
|---|---|---|---|
| 100 | 15 | 2 | ○ |
| | 10 | 15 | x |
| | 5 | 65 | x |
| 75 | 15 | 2 | ○ |
| | 10 | 2 | ○ |
| | 5 | 15 | x |
| 50 | 15 | 2 | ○ |
| | 10 | 2 | ○ |
| | 5 | 2 | ○ |
| 25 | 0 | 2 | ○ |
| 10 | 0 | 2 | ○ |

*1"AIR" is the average image ratio.
*2"TBL" is the toner band length.
*3"WH" is the wax height.

As can be understood from Table 2, when the toner band length of the toner band is set at 15 mm or more, the generation of the image defect due to the lump of the wax can be suppressed irrespective of the average image ratio. However, from the viewpoint of the suppression of the toner consumption, it is preferable that the toner band length is changed depending on the average image ratio and then the toner band can be formed. From the experimental result of Table 2, in the case where the average image ratio is 25% or less, the toner band may be not formed. In the case where the average image ratio is more than 25% and 50% or less, the toner band may only be required to be formed with the width (toner band length) of 5 mm. In the case where the average image ratio is more than 50% and 75% or less, the toner band may only be required to be formed with the width of 10 mm. In the case where the average image ratio is more than 75% and 100% or less, the toner band may only be required to be formed with the width of 15 mm. Thus, it is desirable that the toner band length is made larger with an increasing average image ratio.

Fifth Embodiment

Figure 11:
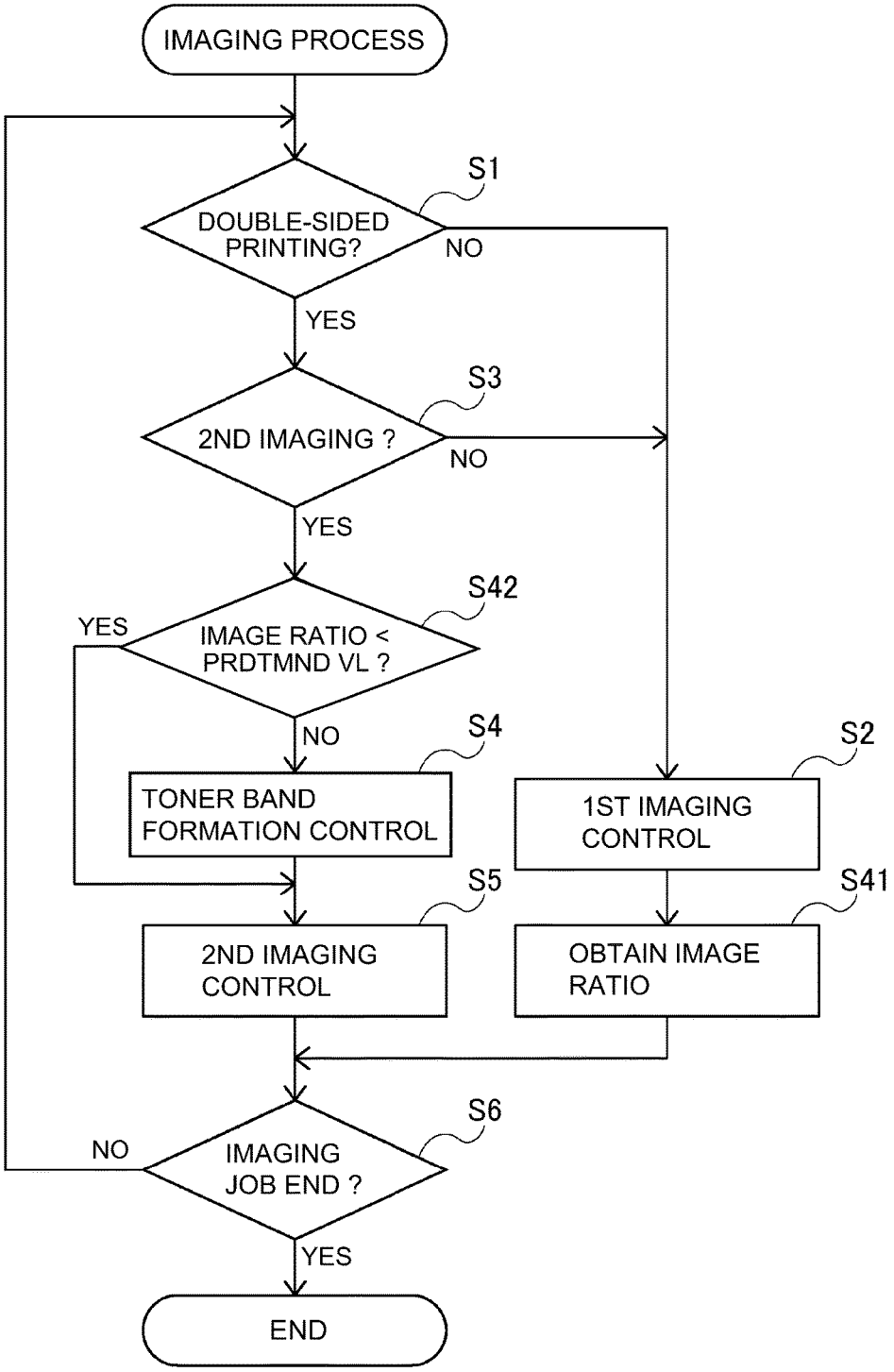
FIG. 11 is a flowchart showing an image forming process in Fifth Embodiment.

As described, by forming the toner band while changing the toner band length depending on the average image ratio, it is possible to suppress the generation of the image defect due to the lump of the wax while suppressing the toner consumption. FIG. 11 shows specific control.

FIG. 11 is a flowchart of an image forming process in this embodiment. This image forming process is executed by the controller 200. Incidentally, the image forming process shown in FIG. 11, steps which are the same as those in the image forming process shown in First Embodiment (FIG. 1) are represented by the same reference numerals or symbols and will be omitted from detailed description.

After the controller 200 executes the image forming control for forming the toner images on the first surfaces of the recording materials (S2), the controller 200 acquires an average (average image ratio) of the image ratios of the toner images formed on the first surfaces of the plurality of recording materials P (S41). The reason why the average image ratio for the first surfaces is acquired is that the wax that is capable of being deposited from the toner image onto the secondary transfer belt 12 when the first surface of the recording material P on which the toner image is fixed contacts the secondary transfer belt 12 during the secondary transfer. The average image ratio is acquired from an integrated value (video count value VC) of a digital image signal output level of respective pixels per (one) page of the recording material P. For example, a video count value VCy of the yellow image forming portion PY is an integrated value of signal values $n_{i,j}$ (i is the ordinate and j is the abscissa) of pixels constituting the associated image, and is calculated from equation 1. In the equation 1, "W" is a coordinate corresponding to a width of the image with respect to a main scan direction (corresponding to the widthwise direction), and "h" is a coordinate corresponding to a width of the image with respect to a sub-scan direction (corresponding to the rotational direction of the secondary transfer belt 12).

$$VCy = n_{1,1} + n_{1,2} + n_{1,3} + \ldots\ n_{2,1} + n_{2,2} + n_{2,3} + \ldots\ n_{w,h} \qquad \text{(Equation 1)}$$

A final video count value VC is acquired by adding up the video count values for the respective four colors. Then, the average image ratio is acquired by diving the video count value VC by an area of one page of the recording material P. Here, the average image ratio in the case where a solid image of a single color is formed in an entire region of an A3-sized recording material P is 100%. For example, in the case where the solid image is formed in the entire region of the A3-sized recording material P with the toners of, e.g., two colors, the average image ratio is 200%.

Referring again to FIG. 11, in the case where the controller 200 discriminated that the image forming surface is the second surface (back surface) of the recording material P (YES of S3), the controller 200 discriminates whether or not the average image ratio is not more than a predetermined value (e.g., 25%) (S42). In the case where the average image ratio is less than the predetermined value (YES of S42), the controller 200 jumps to the process of S5. Thus, in the case where the average image ratio is not more than 25% in the operation in the double-sided printing mode, the toner band is not formed on the secondary transfer belt 12. In the case where the average image ratio is more than the predetermined value (e.g., 25%) (NO of S42), the controller 200 executes the toner band forming control for forming the toner image on the secondary transfer belt 12 (S4). However, in this case, the controller 200 forms the toner band having the toner band length depending on the average image ratio. Specifically, as described above, the toner band is formed in the width of 5 mm when the average image ratio is more than 25% and 50% or less, in the width of 10 mm when the average image ratio is more than 50% and 75% or less, and in the width of 15 mm when the average image ratio is more than 75% and 100% or less. Thus, when the toner amount of the toner image formed on the first surface is smaller than a threshold, the toner band short in toner band length than a predetermined value (e.g., 15 mm) is formed.

As described above, in Fifth Embodiment, the toner band is formed in the toner band length changed depending on the average image ratio of the toner image formed on the first surface. That is, the toner band having the toner band length in which the toner amount capable of meeting the amount of the wax capable of bleeding from the toner image formed on the first surface can be supplied to the cleaning blade 90 is formed. As a result, it is possible to suppress generation of the image defect due to the lump of the wax while suppressing the toner consumption.

As have already been described above, the toner supplied to the cleaning blade 90 functions as the lubricant by being sandwiched between the edge portion 90*a* and the secondary transfer belt 12 and can permit the passing of the wax scraped by the edge portion 90*a*. However, the toner sandwiched between the edge portion 90*a* and the secondary transfer belt 12 is slight in amount, but can pass through the edge portion 90*a*, so that the toner gradually decreases with a lapse of time when the toner is not supplied (FIG. 10). In the case where the image is formed on the recording material P long in size with respect to the recording material P feeding direction, compared with the recording material P short in size with respect to the same direction, an interval between toner bands formed on the secondary transfer belt 12 increases, i.e., a toner supplying interval increases. For that reason, until the toner is supplied to the cleaning blade 90, i.e., during the image formation on the recording material P, the toner sandwiched between the edge portion 90*a* and the secondary transfer belt 12 decreases, so that it becomes difficult to obtain an effect of suppressing the generation of the lump of the wax. Further, minute vibration (so-called shuddering) can generate.

The present inventors conducted an experiment for checking generation or non-generation of the image defect in the case where the toner band length of the toner band was changed. In the experiment, the image was repetitively formed on 2,000 A3-sized sheets under a condition in which a weight ratio (T/D) of the toner and the carrier in the developer during start of a continuous image forming job was 8% and in which an image ratio and an environment and the like were the same. Incidentally, in order to facilitate understanding of the influence by the wax, the image ratio was set at 200%. The toner bands were formed in toner band lengths of 5 mm, 10 mm and 15 mm in the form of a solid image having the toner deposition amount of 50% with the yellow toner over an entire region of the cleaning blade 90 with respect to the longitudinal direction.

An experimental result is shown in Table 3. In Table 3, the height of the wax deposited on the edge portion 90*a* and whether or not the stripe image defect occurred on the recording material P are shown every toner band length of the toner band. The case where the stripe image defect occurred is represented by "x".

TABLE 3

| TBL*1 (mm) | TDA*2 (%) | WH*3 (μm) | Image |
|---|---|---|---|
| 5 | 50 | 65 | x |
| 10 | 50 | 15 | x |
| 15 | 50 | 2 | ○ |

*1"TBL" is the toner band length.
*2"TDA" is the toner deposition amount of the toner band.
*3"WH" is the wax height.

As can be understood from Table 3, in the case where the toner band length of the toner band was 10 mm or less, the stripe image defect occurred. When the cause thereof was diagnosed, it was confirmed that at the position where the stripe image defect occurred, the toner was moved from the front surface side to the rear surface side of the cleaning blade 90 (from the upstream side to the downstream side of the secondary transfer belt 12). When the edge portion 90*a* was observed in an enlarged state through the microscope, it turned out that the toner passed through the side of the deposited wax. When the wax height was measured, the height was about 15 μm at the toner band length of 10 mm and was about 65 μm at the toner band length of 5 mm. The average particle size of the toner was 7 μm, and therefore at the edge portion 90*a*, the wax is deposited in a height sufficient for the toner to pass through the side of the wax and the lump of the wax was generated.

Further, the present inventors repetitively effects image formation similar to that in the case of the A3-sized recording material P by changing the A3-sized recording material P to an A4-sized recording material P. However, in order to make an image area of toner images formed on the recording materials P the same as that in the case of the A3-sized recording material P, the image was formed on 4,000 A4-sized sheets of the recording materials P. An experimental result is shown in Table 4.

TABLE 4

| TBL*1 (mm) | TDA*2 (%) | WH*3 (μm) | Image |
|---|---|---|---|
| 5 | 50 | 63 | x |
| 10 | 50 | 3 | ○ |
| 15 | 50 | 3 | ○ |

*1"TBL" is the toner band length.
*2"TDA" is the toner deposition amount of the toner band.
*3"WH" is the wax height.

As can be understood from Table 4, in the case where the toner band length of the toner band was 5 mm, the stripe image defect occurred. When the wax height was measured, the height was 63 μm larger than the average particle size of 7 μm of the toner. That is, it would be considered that the lump of the wax was generated at the edge portion 90*a* and therefore the toner passed through the edge portion 90*a* and caused the image defect.

As can be understood from the experimental results shown in Tables 3 and 4, when the toner band length of the toner band is made 15 mm or more, it is possible to suppress the generation of the image defect due to the lump of the wax even in the cases of A3-sized recording material P and the A4-sized recording material P. However, when the toner band having the toner band length of 15 mm or more is always formed, the toner consumption increases. Therefore, from the viewpoint of suppression of the toner consumption, it is desirable that the toner band length of the toner band is changed depending on the size of the recording material P.

Figure 12:
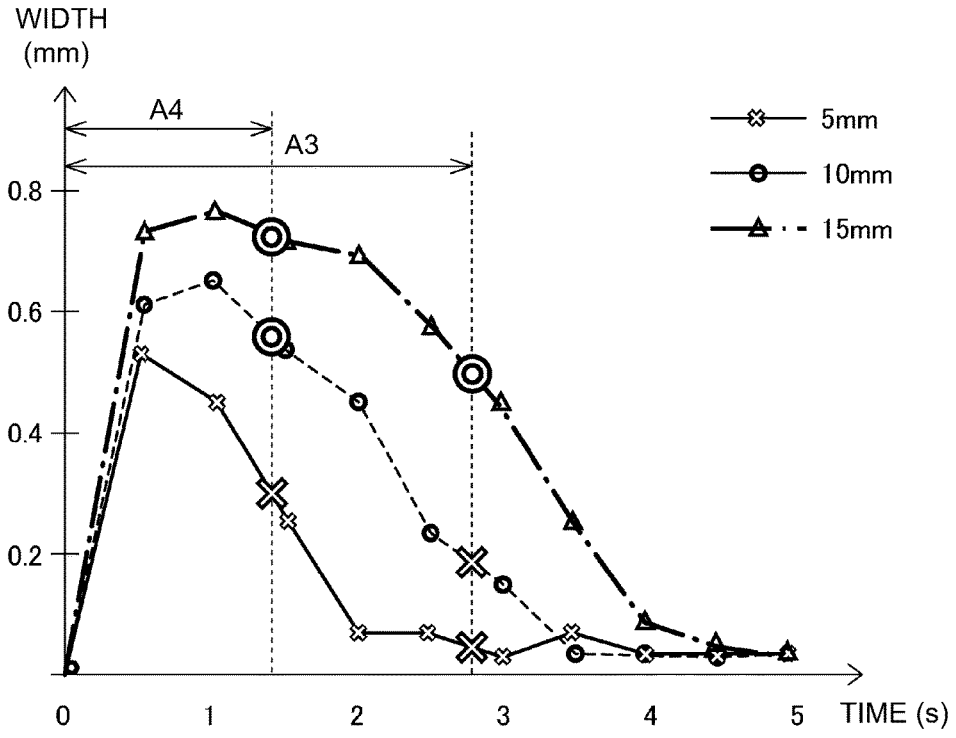
FIG. 12 is a graph showing generation or non-generation of an image defect on each of recording materials different in size for each of toner band lengths.

FIG. 12 is a graph showing generation or non-generation of the image defect on recording materials P different in size for each of the toner band lengths of the toner bands. In the figure, "◎" represents that the image defect did not occur, and "X" represents that the image defect occurred. Incidentally, a time (sheet passing time) required for passing of the A4-sized recording material P through the secondary transfer portion T2 is about 1.4 sec, and a time required for passing of the A3-sized recording material P through the secondary transfer portion T2 is about 2.8 sec.

As shown in FIG. 12, in both of the cases of the A4-sized recording material P and the A3-sized recording material P, when the residual toner width is 0.4 mm or more, the image defect does not occur irrespective of the toner band length of the toner band. That is, the residual toner width gradually decreases with a lapse of time. However, in a period until the A4-sized or A3-sized recording material P completely passes through the secondary transfer portion T2, the residual toner width is ensured so as to be 0.4 mm or more and the toner functions as the lubricant. For that reason, the lump of the wax is not readily formed at the edge portion 90*a*.

A time required for passing of the recording material P through the secondary transfer portion T2 is determined depending on the size (specifically the length with respect to the feeding direction) of the recording material P. In order to ensure the residual toner width of 0.4 mm or more in period until the recording material P completely passes through the secondary transfer portion T2, the toner band length of the toner band may preferably be made larger with an increasing size of the recording material P. As shown in FIG. 12, in the case of the A4-sized recording material P, the toner band of 10 mm in toner band length may only be required to be formed, and in the case of the A3-sized recording material P, the toner band of 15 mm in toner band length may only be required to be formed. In this embodiment, the A4-sized recording material P and the A3-sized recording material P were described as an example, but the recording material P may also have other sizes. Even in that case, by changing the toner band length of the toner band depending on the size of the recording material P, it is possible to suppress the generation of the image defect due to the lump of the wax while suppressing the toner consumption.

Sixth Embodiment

Figure 13:
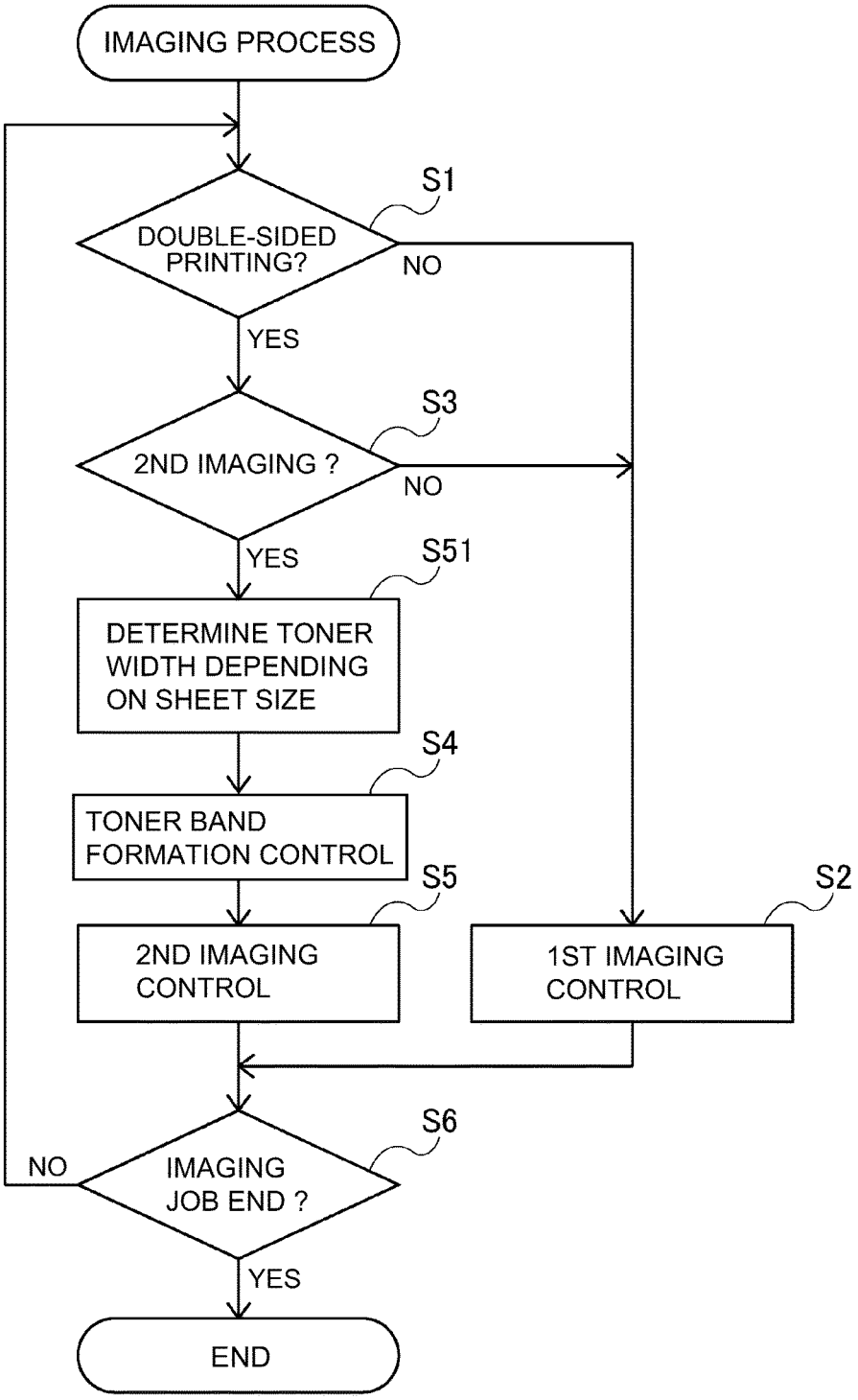
FIG. 13 is a flowchart showing an image forming process in Sixth Embodiment.

As described, when the toner band is formed while changing the toner band length depending on the size of the recording material P, it is possible to suppress the generation of the image defect due to the lump of the wax while suppressing the toner consumption. FIG. 13 shows specific control.

FIG. 13 is a flowchart of an image forming process in this embodiment. This image forming process is executed by the controller 200. Incidentally, the image forming process shown in FIG. 13, steps which are the same as those in the image forming process shown in First Embodiment (FIG. 1) are represented by the same reference numerals or symbols and will be omitted from detailed description. Further, for easy understanding of explanation, the case using the A4-sized recording material P and the A3-sized recording material P will be described as an example.

In the case where the controller 200 discriminates that the image forming surface is the second surface (back surface) (YES of S3), the controller 200 determines the toner band length depending on the size of the recording material P (S51). The size of the recording material P is designated, e.g., by operation of the operating portion 201 by the user when the user provides an instruction to start execution of the continuous image forming job through the operating portion 201. Then, the toner band length is determined as a width determined in advance for each size. The toner band length for each size is stored in advance in the memory or the like of the controller 200. When the toner band forming control is executed (S4), the controller 200 controls the image forming apparatus 100, and forms the toner band having the determined toner band length on the secondary transfer belt 12. Thus, the toner band length is changed correspondingly to the size of the recording material P. Specifically, the toner band is formed in the width of 10 mm for the A4-sized recording material P and is formed in the width of 15 mm for the A3-sized recording material P.

As described above, in Sixth Embodiment, the toner band was also to be formed in the toner band length changed depending on the size of the recording material P. That is, a larger toner image can be formed on the first surface as the size of the recording material P is larger, and therefore, in that case, the toner band having the toner band length containing the toner amount capable of meeting the amount of the wax capable of bleeding from the toner image formed on the first surface was able to be formed. As a result, it is possible to suppress generation of the image defect due to the lump of the wax while suppressing the toner consumption.

Further, in view of realization of both of the suppression of the toner consumption and the suppression of the generation of the image defect, the changing manner is not limited to that in which the toner band length of the toner band is changed depending on the size of the recording material P but may also be a changing manner in which the toner deposition amount of the toner band is changed depending on the size of the recording material P. In summary, the amount of the toner supplied to the cleaning blade 90 may only be required to be adjusted.

Figure 14:
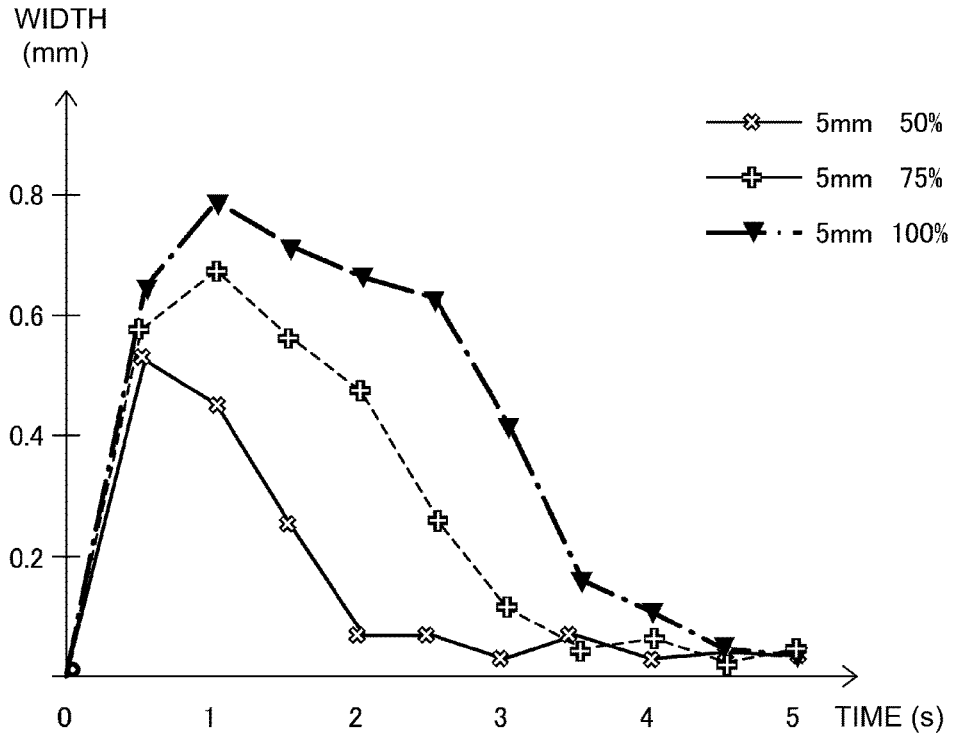
FIG. 14 is a graph showing a relationship between a toner deposition amount and a time progression of a toner amount at an edge portion.

FIG. 14 shows a relationship between the toner deposition amount of the toner band and the time progression of the toner amount at the edge portion 90*a*. As an index of the toner amount, the width (residual toner width) of the toner remaining on the secondary transfer belt 12 was measured as described above. The toner band was formed in the toner band length of 5 mm in the entire region of the cleaning blade 90 with respect to the longitudinal direction so that the toner band was formed as a solid image with the yellow toner in the toner deposition amount of each of 50%, 75% and 100%.

As can be understood from FIG. 14, immediately after supply of the toner (after 0.5 sec), the toner accumulated in a sufficient amount at the edge portion 90*a*, but the residual toner width gradually decreases with a lapse of time. When the toner deposition amount of the toner deposition amount is increased from 50% to 100%, the time is prolonged until the residual toner width is unchanged.

The present inventors conducted an experiment for checking generation or non-generation of the image defect in the case where the toner deposition amount of the toner band was changed. In the experiment, the image was repetitively formed on 2,000 A3-sized sheets under a condition in which a weight ratio (T/D) of the toner and the carrier in the developer during start of a continuous image forming job was 8% and in which an image ratio and an environment and the like were the same. Incidentally, in order to facilitate understanding of the influence by the wax, the image ratio was set at 200%.

An experimental result is shown in Table 5. In Table 5, the height of the wax deposited on the edge portion 90*a* and whether or not the stripe image defect generated on the recording material P are shown for every toner deposition amount of the toner band. The case where the stripe image defect generated is represented by "x".

TABLE 5

| TBL*1 (mm) | TDA*2 (%) | WH*3 (μm) | Image |
|---|---|---|---|
| 5 | 50 | 80 | x |
| 5 | 75 | 21 | x |
| 5 | 100 | 2 | ○ |

*1"TBL" is the toner band length.
*2"TDA" is the toner deposition amount of the toner band.
*3"WH" is the wax height.

As can be understood from Table 5, in the case where the toner deposition amount of the toner band was 75% or less, the stripe image defect generated. When the cause thereof was diagnosed, it was confirmed that at the position where the stripe image defect occurred, the toner was moved from the front surface side to the rear surface side of the cleaning blade 90 (from the upstream side to the downstream side of the secondary transfer belt 12). When the edge portion 90*a* was observed in an enlarged state through the microscope, it turned out that the toner passed through the side of the deposited wax. When the wax height was measured, the height was about g215 μm at the toner deposition amount of 75% and was about 80 μm at the toner deposition amount of 50%. The average particle size of the toner was 7 μm, and therefore at the edge portion 90*a*, the wax is deposited in a height sufficient for the toner to pass through the side of the wax and the lump of the wax generated.

Further, the present inventors repetitively effects image formation similar to that in the case of the A3-sized recording material P by changing the A3-sized recording material P to an A4-sized recording material P. However, in order to make an image area of toner images formed on the recording materials P the same as that in the case of the A3-sized recording material P, the image was formed on 4,000 A4-sized sheets of the recording materials P. An experimental result is shown in Table 6.

TABLE 6

| TBL*1 (mm) | TDA*2 (%) | WH*3 (μm) | Image |
|---|---|---|---|
| 5 | 50 | 79 | x |
| 5 | 75 | 3 | ○ |
| 5 | 100 | 2 | ○ |

*1"TBL" is the toner band length.
*2"TDA" is the toner deposition amount of the toner band.
*3"WH" is the wax height.

As can be understood from Table 6, in the case where the toner deposition amount of the toner band was 50% or less, the stripe image defect occurred. When the wax height was measured, the height was 79 μm larger than the average particle size of 7 μm of the toner. That is, it would be considered that the lump of the wax was generated at the edge portion 90*a* and therefore the toner passed through the edge portion 90*a* and caused the image defect.

As can be understood from the experimental results shown in Tables 5 and 6, when the toner deposition amount of the toner band is made 100% or more, it is possible to suppress the generation of the image defect due to the lump of the wax even in the cases of A3-sized recording material P and the A4-sized recording material P. However, when the toner band having the toner deposition amount of 100% is always formed, the toner consumption increases. Therefore, from the viewpoint of suppression of the toner consumption, it is desirable that the toner deposition amount of the toner band is changed depending on the size of the recording material P.

Figure 15:
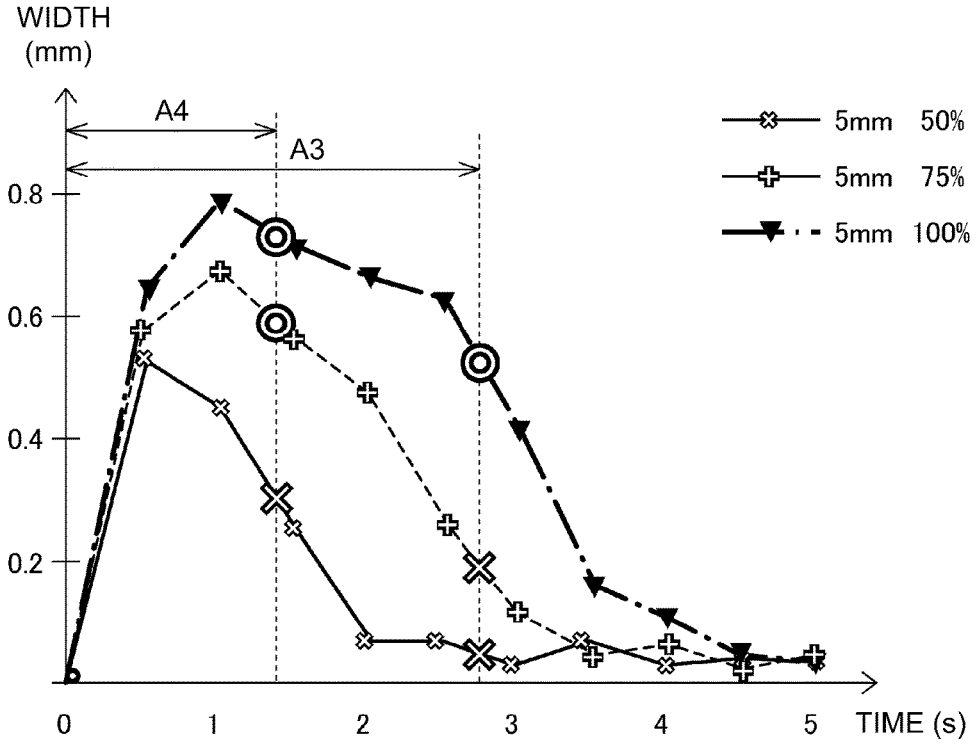
FIG. 15 is a graph showing generation or non-generation of an image defect on each of recording materials different in size for each of toner deposition amounts.

FIG. 15 is a graph showing generation or non-generation of the image defect on recording materials P different in size for each of the toner deposition amounts of the toner bands. In the figure, "◎" represents that the image defect did not occur, and "X" represents that the image defect occurred.

As shown in FIG. 15, in both of the cases of the A4-sized recording material P and the A3-sized recording material P, when the residual toner width is 0.4 mm or more, the image defect does not occur irrespective of the toner deposition amount of the toner band. That is, the residual toner width gradually decreases with a lapse of time. However, in a period until the A4-sized or A3-sized recording material P completely passes through the secondary transfer portion T2, the residual toner width is ensured so as to be 0.4 mm or more and the toner functions as the lubricant. For that reason, the lump of the wax is not readily formed at the edge portion 90*a*.

A time required for passing of the recording material P through the secondary transfer portion T2 is determined depending on the size (specifically the length with respect to the feeding direction) of the recording material P. In this embodiment, the time is about 1.4 sec for the A4-sized recording material P and is about 2.8 sec for the A3-sized recording material P. In order to ensure the residual toner width of 0.4 mm or more in period until the recording material P completely passes through the secondary transfer portion T2, the toner deposition amount of the toner band is required to be made larger with an increasing size of the recording material P. As shown in FIG. 15, in the case of the A4-sized recording material P, the toner band of 75% in toner deposition amount may only be required to be formed, and in the case of the A3-sized recording material P, the toner band of 100% in toner deposition amount may only be required to be formed.

Seventh Embodiment

Figure 16:
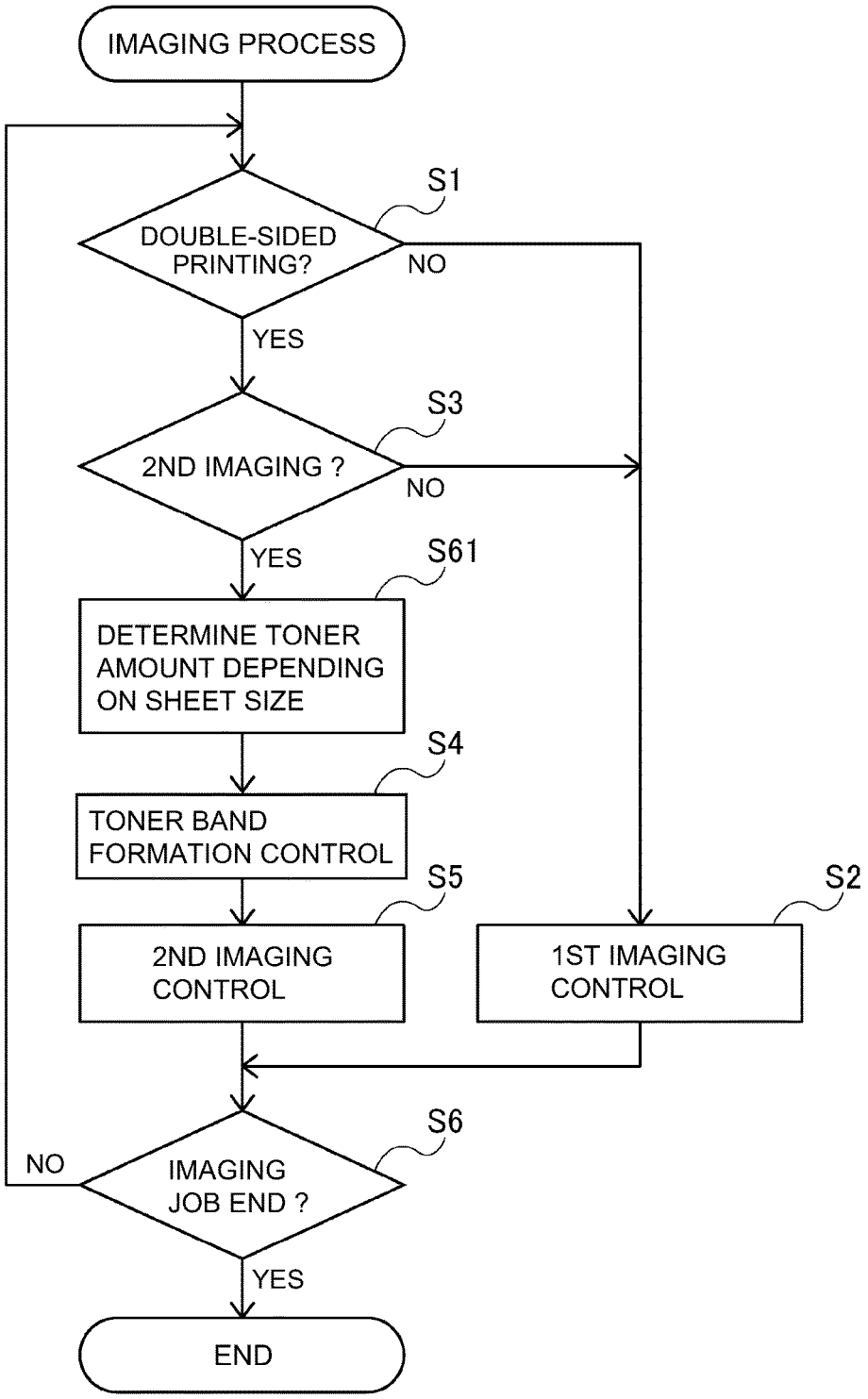
FIG. 16 is a flowchart showing an image forming process in Seventh Embodiment.

As described, by forming the toner band while changing the toner deposition amount depending on the size of the recording material P, it is possible to suppress the generation of the image defect due to the lump of the wax while suppressing the toner consumption. FIG. 16 shows specific control.

FIG. 16 is a flowchart of an image forming process in this embodiment. This image forming process is executed by the controller 200. Incidentally, the image forming process shown in FIG. 16, steps which are the same as those in the image forming process shown in Sixth Embodiment (FIG. 13) except that a process of S61 is different from the process of S51 in FIG. 13 are represented by the same reference numerals or symbols and will be omitted from detailed description. Further, for easy understanding of explanation, the case using the A4-sized recording material P and the A3-sized recording material P will be described as an example.

In the case where the controller 200 discriminates that the image forming surface is the second surface (back surface) (YES of S3), the controller 200 determines the toner deposition amount depending on the size of the recording material P (S61). The size of the recording material P is designated, e.g., by operation of the operating portion 201 by the user when the user provides an instruction to start execution of the continuous image forming job through the operating portion 201. Then, the toner deposition amount is determined as a width determined in advance for each size. The toner deposition amount for each size is stored in advance in the memory or the like of the controller 200. When the toner band forming control is executed (S4), the controller 200 controls the image forming apparatus 100, and forms the toner band having the determined toner deposition amount on the secondary transfer belt 12. Thus, the toner deposition amount is changed correspondingly to the size of the recording material P. Specifically, the toner band is formed in the toner deposition amount of 75% for the A4-sized recording material P and is formed in the toner deposition amount of 100% for the A3-sized recording material P.

As described above, in Seventh Embodiment, the toner band was also to be formed in the toner deposition amount changed depending on the size of the recording material P. That is, a larger toner image can be formed on the first surface as the size of the recording material P is larger, and therefore, in that case, the toner band having the toner deposition amount capable of meeting the amount of the wax capable of bleeding from the toner image formed on the first surface was able to be formed. As a result, it is possible to suppress generation of the image defect due to the lump of the wax while suppressing the toner consumption. However, when the toner deposition amount is made excessively large, the cleaning blade 90 cannot completely remove the toner band itself and thus the image defect can generate and there is a high possibility that the toner scattering generates, and therefore, it is preferable that the toner band length is changed. Incidentally, by changing both of the toner band length and the toner deposition amount of the toner band depending on the size of the recording material P, compatibility of the suppression of the toner consumption and the suppression of the generation of the image defect may also be realized.

In the above-described First to Seventh Embodiments, the toner band is formed over the entire region of the cleaning blade 90 contacting the secondary transfer belt 12 with respect to the longitudinal direction. However, at the edge portion 90*a*, the wax accumulates at a portion corresponding to the position (region) of the recording material P having the first surface on which the toner image is formed. Therefore, from the viewpoint of the suppression of the toner consumption, it is desirable that the toner band is not formed over the entire longitudinal region of the cleaning blade 90 but is formed only at the portion corresponding to the position (region) of the recording material P having the first surface on which the toner image is formed. Further, it is desirable that formation or non-formation of the toner band is determined depending on the image ratio of the first surface of the recording material P. This will be described below.

Embodiment 8

Figure 17:
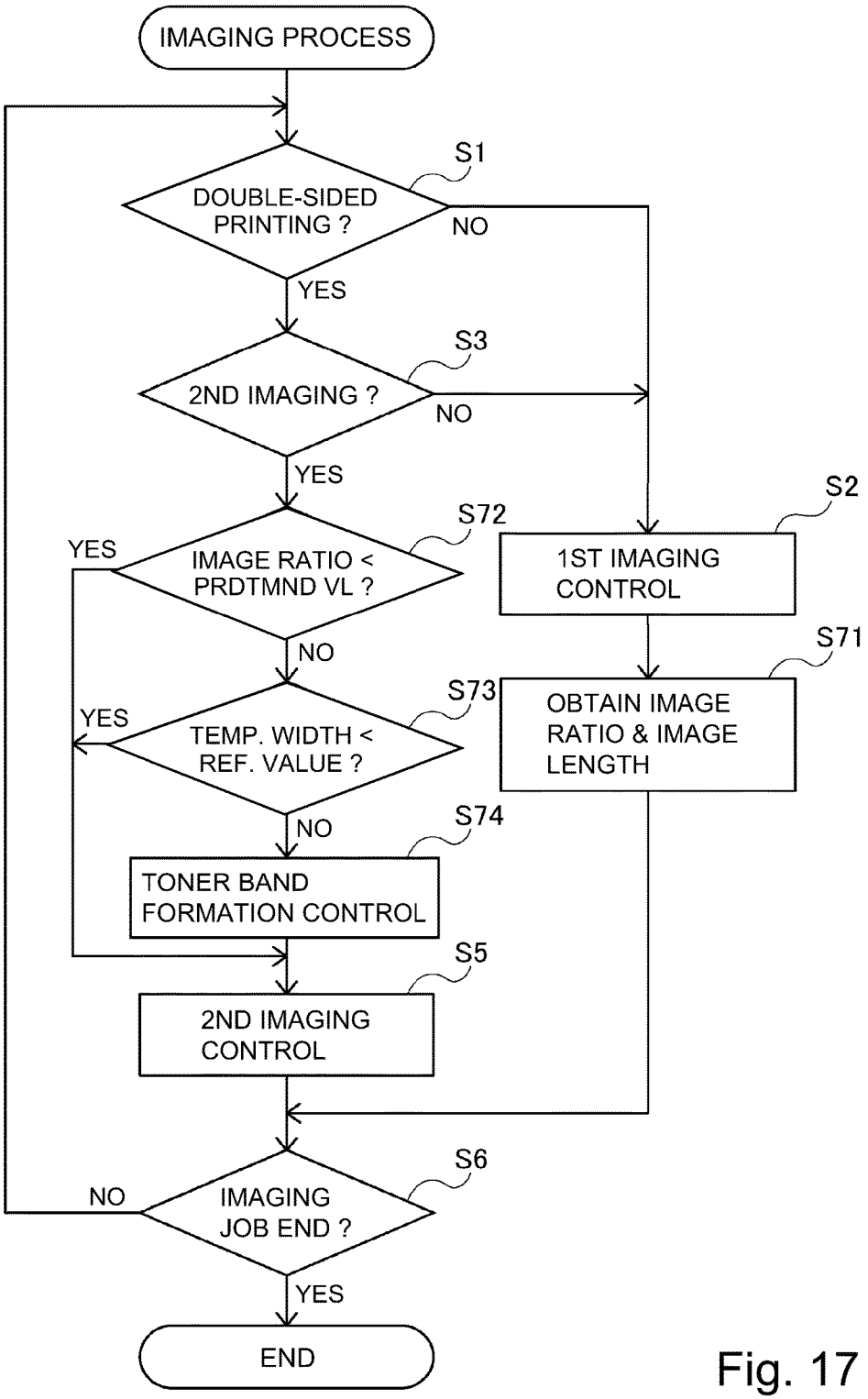
FIG. 17 is a flowchart showing an image forming process in Eighth Embodiment.

FIG. 17 is a flowchart of an image forming process in this embodiment. This image forming process is executed by the controller 200. Incidentally, the image forming process shown in FIG. 17, steps which are the same as those in the image forming process shown in First Embodiment (FIG. 1) are represented by the same reference numerals or symbols and will be omitted from detailed description.

After the controller 200 executes the image forming control for forming the toner image on the first surface (front surface) of the recording material (S2), the controller 200 acquires an image ratio of the toner image formed on the first surface of the recording material P and a length of the image formed on the first surface of the recording material P with respect to the sub-scan direction (S71). The acquired image ratio and length of the image with respect to the sub-scan direction are stored in the memory or the like of the controller 200 for each recording material P. As have already been described above, the reason why the average image ratio for the first surfaces is acquired is that the wax is capable of being deposited form the toner image onto the secondary transfer belt 12 when the first surface of the recording material P on which the toner image is fixed contacts the secondary transfer belt 12 during the secondary transfer. The image ratio is acquired from an integrated value (video count value VC) of a digital image signal output level of respective pixels per (one) page of the recording material P.

In this embodiment, the video count value VC in one page is divided into 8 portions corresponding to 8 areas of one page divided with respect to the main scan direction, and video count values VC1 to VC8 in the 8 areas, respectively, are acquired. Each of the video count value VC1 to VC8 is an integrated value of signal values $n_{i,j}$ (i is the ordinate and j is the abscissa) of pixels constituting the associated image on ⅛ page, and is calculated from equation 2. In the equation 2, "W" is a coordinate corresponding to a width of the associated ⅛ area of the image with respect to a main scan direction (corresponding to the widthwise direction), and "h" is a coordinate corresponding to a width of the associated 1.8 area of the image with respect to a sub-scan direction (corresponding to the rotational direction of the secondary transfer belt 12). Incidentally, in this embodiment, the case where the video count carrier value VC in one page is divided into 8 portions with respect to the main scan direction of the image was described as an example, but the present invention is not limited thereto. From the viewpoint of the suppression of the toner consumption, the video count value VC may preferably be divided finely.

$$VC1 = n_{1,1} + n_{1,2} + n_{1,3} \ldots n_{2,1} + n_{2,2} + n_{2,3} + \ldots n_{w,h} \quad \text{(Equation 2)}$$

$$VC2 = n_{1,1} + n_{1,2} + n_{1,3} \ldots n_{2,1} + n_{2,2} + n_{2,3} + \ldots n_{w,h}$$

$$VC3 = n_{1,1} + n_{1,2} + n_{1,3} \ldots n_{2,1} + n_{2,2} + n_{2,3} + \ldots n_{w,h}$$

$$VC4 = n_{1,1} + n_{1,2} + n_{1,3} \ldots n_{2,1} + n_{2,2} + n_{2,3} + \ldots n_{w,h}$$

$$VC5 = n_{1,1} + n_{1,2} + n_{1,3} \ldots n_{2,1} + n_{2,2} + n_{2,3} + \ldots n_{w,h}$$

$$VC6 = n_{1,1} + n_{1,2} + n_{1,3} \ldots n_{2,1} + n_{2,2} + n_{2,3} + \ldots n_{w,h}$$

$$VC7 = n_{1,1} + n_{1,2} + n_{1,3} \ldots n_{2,1} + n_{2,2} + n_{2,3} + \ldots n_{w,h}$$

$$VC8 = n_{1,1} + n_{1,2} + n_{1,3} \ldots n_{2,1} + n_{2,2} + n_{2,3} + \ldots n_{w,h}$$

Each of final video count values V11 to VC8 is acquired by adding up the video count values for the respective four colors. Then, the average image ratio is acquired by dividing each of the video count values VC1 to VC8 by an area of the associated ⅛ area of one page of the recording material P. For example, in the case where an image region width with respect to the main scan direction is 324 mm, when the image region is divided into 8 areas, the width of each area (⅛ area of the image region) with respect to the main scan direction is 40.5 mm. For that reason, an (planar) area of each area of the recording material P is "(40.5 mm)×(length of recording material P with respect to feeding direction)". However, in the area containing an end portion of the recording material P, the (planar) area is "(length to end portion of recording material P in associated area)×(length of recording material P with respect to feeding direction)".

Figure 18:
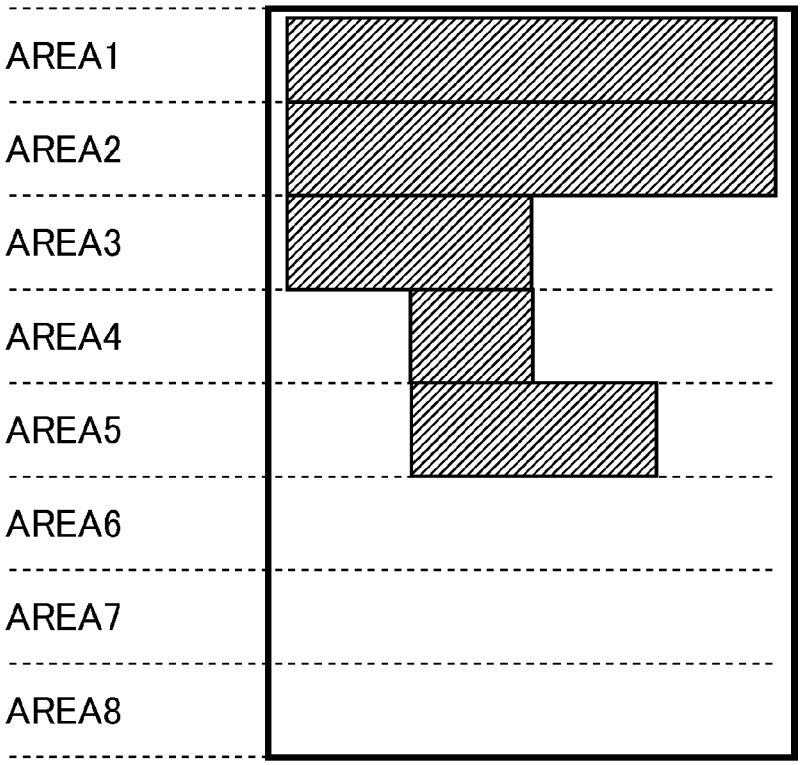
FIG. 18 is a schematic view for illustrating an image ratio in each of regions.

FIG. 18 is a schematic view for illustrating the image ratio of each of the 8 areas ("AREA1" to "AREA8"). In FIG. 18, of the divided 8 areas, the case where the solid image was formed in the entire region (range) of AREA1 and AREA2, in ½ region (range) of AREA3 and AREA5 and in ¼ region (range) of AREA4, and is not formed in AREA6, AREA 7 and AREA 8 was shown. When the image ratios of the respective areas are acquired in the above-described manner, the image ratios are 100% in AREA1 and AREA2, 50% in AREA3 and AREA5, 25% in AREA4, and 0% in AREA6, AREA7 and AREA 8.

Further, the length of the image formed on the first surface of the recording material P with respect to the main scan direction is acquired for each of the divided 8 areas. The length with respect to the main scan direction is, e.g., 210 mm when the solid image is formed in the entire region of an A4-sized recording material of landscape or orientation fed by short edge feeding, 420 mm when the solid image is formed in the entire region of an A3-sized recording material of portrait orientation fed by long edge feeding, and 364 mm when the solid image is formed in the entire region of a B3-sized recording material of portrait orientation fed by long edge feeding.

Referring again to FIG. 17, in the case where the controller 200 discriminated that the image forming surface is the second surface (back surface) of the recording material P (YES of S3), the controller 200 executes processes of S72 to S74 in each of the 8 areas. The controller 200 reads the image ratio of the image forming surface of the recording material P from the memory, and discriminates whether or not the read image ratio is less than a predetermined value (e.g., 50%) (S72). In the case where the image ratio is less than the predetermined value (YES of S72), the controller 200 jumps to the process of S5. Thus, in the area in which the image ratio is less than 50%, even when the toner image is formed on the first surface, the toner band is not formed on the secondary transfer belt 12.

In the case where the image ratio is not less than the predetermined value (e.g., 50%) (NO of S72), the controller 200 discriminates whether or not a temporary image forming width is less than a reference value (e.g., 5 mm) (S73). In the case where the temporary image forming width is less than the reference value (e.g., 5 mm) (YES of S73), the controller 200 jumps to the process of S5. Also in this case, the toner band is not formed on the secondary transfer belt 12. In the case where the temporary image forming width is more than the reference value (e.g., 5 mm) (NO of S73), the controller 200 executes the toner band forming control for forming the toner image on the secondary transfer belt 12 (S74). In this case, the controller 200 controls the image forming apparatus 100 and forms the toner band on the secondary transfer belt 12 in a sheet interval between a recording material P and a subsequent recording material P. In the case of FIG. 18 described above, the toner band is formed in the regions corresponding to AREA1 to AREA3 and AREA4 in which the image ratio is 50% or more, and is not formed in the regions corresponding to AREA4 and AREA6 to AREA8 in which the image ratio is less than 50%. That is, in this case, the toner band is formed in at least a part of a range corresponding to the recording material P with respect to the main scan direction (widthwise direction). Further, in the case where the solid image is formed in the entire region of the recording material P having, e.g., an A3 size (420 mm×297 mm), when the toner band is formed in the toner band length of 5 mm, it is confirmed from an experiment that the image defect does not generate. Therefore, in this embodiment, as the reference value of the toner band length, "5 mm" is set. Incidentally, the reference value is not limited thereto.

In this embodiment, a frequency of formation of the toner band is changed depending on the length of the image formed on the recording material P with respect to the sub-scan direction. As have already been described above, in view of non-generation of the image defect when the toner band having the toner band length of 5 mm is formed in the case the recording material P is A3 in size, there is no need to form the toner band until the image having the length (reference length) corresponding to the length of the A3-sized recording material P is formed on the recording material P. Therefore, a temporary toner band length (temporary image forming width) is acquired on the basis of an integrated value of lengths of images with respect to the sub-scan direction in the case where the image ratio is 50% or more, and when the temporary image forming width is not less than the reference value (e.g., 5 mm), the toner band was formed. The temporary image forming width is obtained by the following equation 3. In the equation 3, "VCP" is an integrated value of lengths of the images with respect to the sub-scan direction in the case where the image ratio is 50% or more.

$$\text{Temporary image forming width} = (\text{last temporary image forming width}) + \{(\text{reference value of toner band length}) \times VCP \times (\text{reference length})\} \quad \text{(Equation 3)}$$

The controller 200 forms the toner band when the temporary image forming width is not less than the reference value (e.g., 5 mm), and does not form the toner band when the temporary image forming width is less than the reference value (e.g., 5 mm) (S73). In the case where the toner band is formed, the controller 200 subtracts the reference value from the temporary image forming width. For example, in the case where a first sheet of the A4-sized recording material P (landscape orientation) on which the solid image is formed in the entire region, even when the image ratio is 100%, the temporary image forming width is 2.5 mm (5×210/420), and therefore the toner band is not formed. In the case where a subsequent second sheet of the recording material P on which the image is to be formed is fed, the temporary image forming width is 5.0 mm (5×210×2/420), and therefore the toner band is formed. Thereafter, the reference value is subtracted from the temporary image forming width, so that the temporary image forming width becomes 0.

For example, in the case where a first sheet of the B4-sized recording material P (portrait orientation) on which the solid image is formed in the entire region, the temporary image forming width is 4.33 mm (5×364/420), and therefore the toner band is not formed. In the case where a subsequent second sheet of the recording material P on which the image is to be formed is fed, the temporary image forming width is 8.67 mm (5×364×2/420), and therefore the toner band is formed. Thereafter, the reference value is subtracted from the temporary image forming width, so that the temporary image forming width becomes 3.67 mm. Subsequently, in the case where a third sheet of the recording material P is fed, the temporary image forming width is 8.00 mm (3.67+(5×364/420), and therefore the toner band is formed. Thereafter, the reference value is subtracted from the temporary image forming width, so that the temporary image forming width becomes 3.00 mm.

As described above, in Eighth Embodiment, the toner amount of the toner image formed on the first surface in each of the divided areas is acquired, and the toner band is formed in the area(s) in which the toner amount is larger than a threshold. As a result, the toner band can be formed only at a portion where the toner image is formed at a high image ratio, so that it is possible to suppress the generation of the image defect due to the lump of the wax while suppressing the toner consumption.

The present inventors conducted an experiment for checking generation or non-generation of the image defect in the case where a frequency of formation and the toner band length of the toner band were changed. In the experiment, the image was repetitively formed on 50,000 A3-sized sheets or more in a state in which the frequency of formation and the toner band length of the toner band were changed, under a condition in which a weight ratio (T/D) of the toner and the carrier in the developer during start of a continuous image forming job was 8% and in which an environment and the like were the same.

An experimental result is shown in Table 7. In Table 7, the case where the stripe image defect occurred was represented by "x", and the number of sheets of the recording materials P at that time was shown.

TABLE 7

| CD*1 | TBL*2 | FR*3 | NGID*4 | Image |
|---|---|---|---|---|
| 1 | No Band | — | 1000 | x |
| 2 | 5 mm | 1 | 6000 | x |
| 3 | 10 mm | 1 | 10000 | x |
| 4 | 25 mm | 1 | ≥50000 | ○ |
| 5 | 25 mm | 20 | 3000 | x |
| 6 | 5 mm | 1 | ≥50000 | ○ |
| " | 25 mm | 20 | ≥50000 | ○ |

*1"CD" is the condition.
*2"TBL" is the toner band length (width) (mm) of the toner band.
*3"FR" is the frequency of formation of the toner band. "1" represents every 1 sheet, and "20" represents every 20 sheets.
*4"NGID" is the number of sheets where the image defect generated.

As can be understood from Table 7, in the case where (Conditions 1 to 3) the toner band length of the toner band was 10 mm or less, the stripe image defect occurred. When the cause thereof was diagnosed, it was confirmed that at the position where the stripe image defect occurred, the toner was moved from the front surface side to the rear surface side of the cleaning blade 90 (from the upstream side to the downstream side of the secondary transfer belt 12). When the edge portion 90*a* was observed in an enlarged state through the microscope, it turned out that the toner passed through the side of the deposited wax. When the wax height was measured, the height was about 20 μm was formed at the toner band length of 5 mm. The average particle size of the toner was 7 μm, and therefore at the edge portion 90*a* of the cleaning blade 90, the wax is deposited in a height sufficient for the toner to pass through the side of the wax and the lump of the wax was generated.

On the other hand, in the case where the toner band length was 25 mm, when the toner band forming frequency is every 1 sheet (Condition 4), even when the image formation on not less than 50,000 sheets of the recording materials P was made, the image defect did not occur. However, when the toner band forming frequency is changed to every 20 sheets (Condition 5), the image defect occurred at about 3,000 sheets. That is, when the toner band length is 25 mm and the toner band forming frequency is every 1 sheet, it is possible to suppress the generation of the image defect due to the lump of the wax. However, in that case, the toner consumption becomes large.

Therefore as shown in Condition 6, the toner band of 5 mm in toner band length was formed every 1 sheet, and the toner band of 25 mm in toner band length was formed every 20 sheets. In this case, even when the image formation on not less than 50,000 sheets of the recording materials P was made, the image defect did not occur. The toner band of 5 mm in toner band length is relatively small in amount of the toner capable of being supplied to the cleaning blade 90. However, when the toner in a small amount can be always supplied to the edge portion 90*a*, it is possible to maintain an amount of the toner functioning as a lubricant by being sandwiched between the edge portion 90*a* and the secondary transfer belt 12. In this case, the wax is not kept in a sandwiched state between the edge portion 90*a* and the secondary transfer belt 12, so that the lump of the wax does not readily generate. However, the image formation is continuously effected on a large number of sheets of the recording materials P, the wax can remain in some cases. The wax which remained can cause the lump of the wax. Therefore, the toner band of 25 mm in toner band in which the amount of the toner capable of being supplied to the cleaning blade 90 is relatively large is formed at predetermined timing, so that the wax is captured by the surfaces of the toner particles and removed by the cleaning blade 90 together with the toner particles. Further, in this case, compared with Condition 4, the toner consumption is small.

Ninth Embodiment

Figure 19:
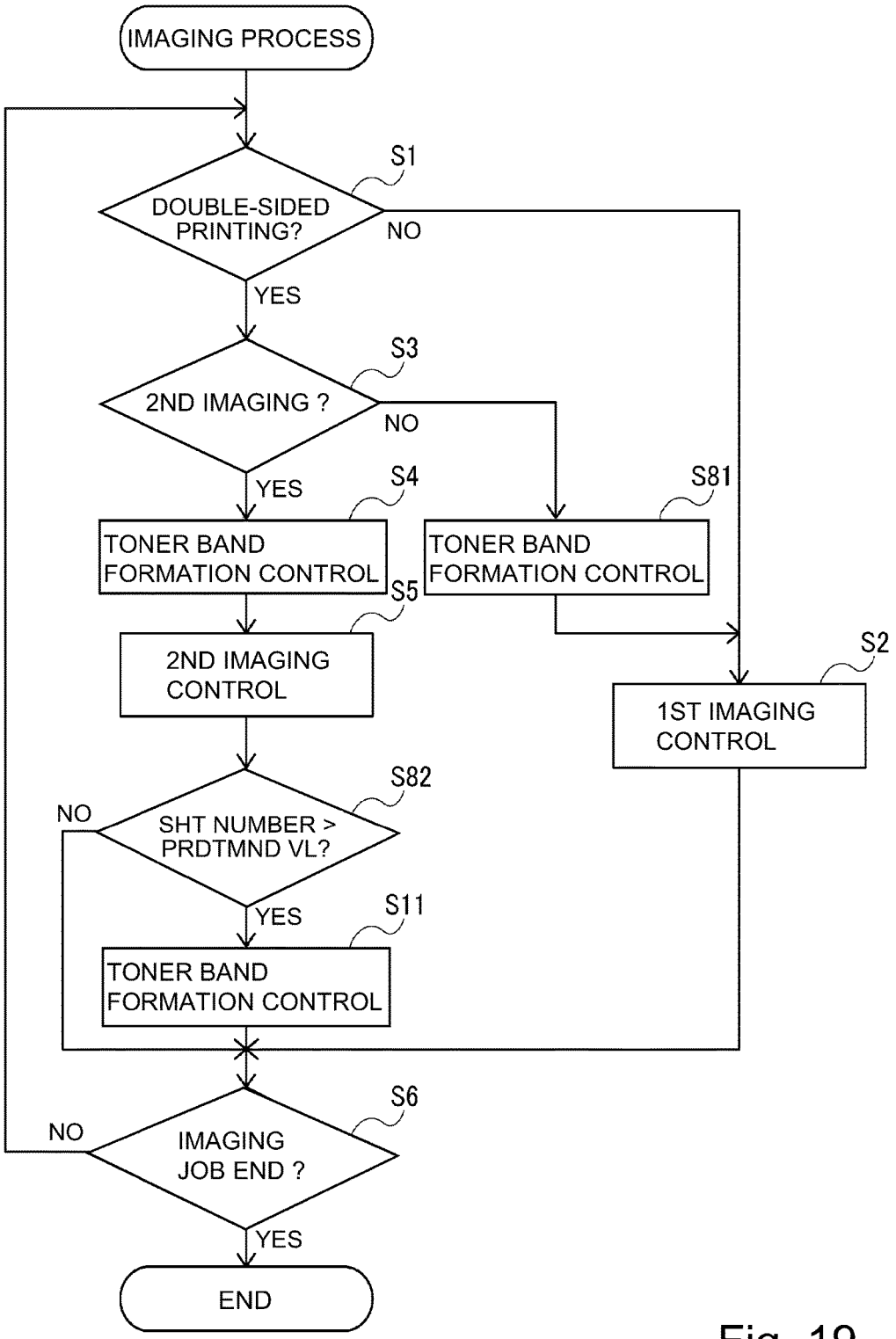
FIG. 19 is a flowchart showing an image forming process in Ninth Embodiment.

FIG. 19 is a flowchart of an image forming process in this embodiment. This image forming process is executed by the controller 200. The image forming process shown in FIG. 19 is only different from the image forming process shown in FIG. 7 in that processes of S81 and S82 are added, and therefore other processes (steps) will be omitted from detailed description.

As shown in FIG. 19, in the case where the controller 200 discriminated that the image forming surface is not the second surface (back surface) of the recording material P (NO of S3), before the image forming control for forming the toner image on the first surface (front surface) of the recording material P is executed (S2), the controller 200 executes the toner band forming control (S81). That is, the toner band is formed immediately in front of the recording material P for the first surface (image formation). The toner image formed at this time is, e.g., 5 mm in toner band length.

Figure 20:
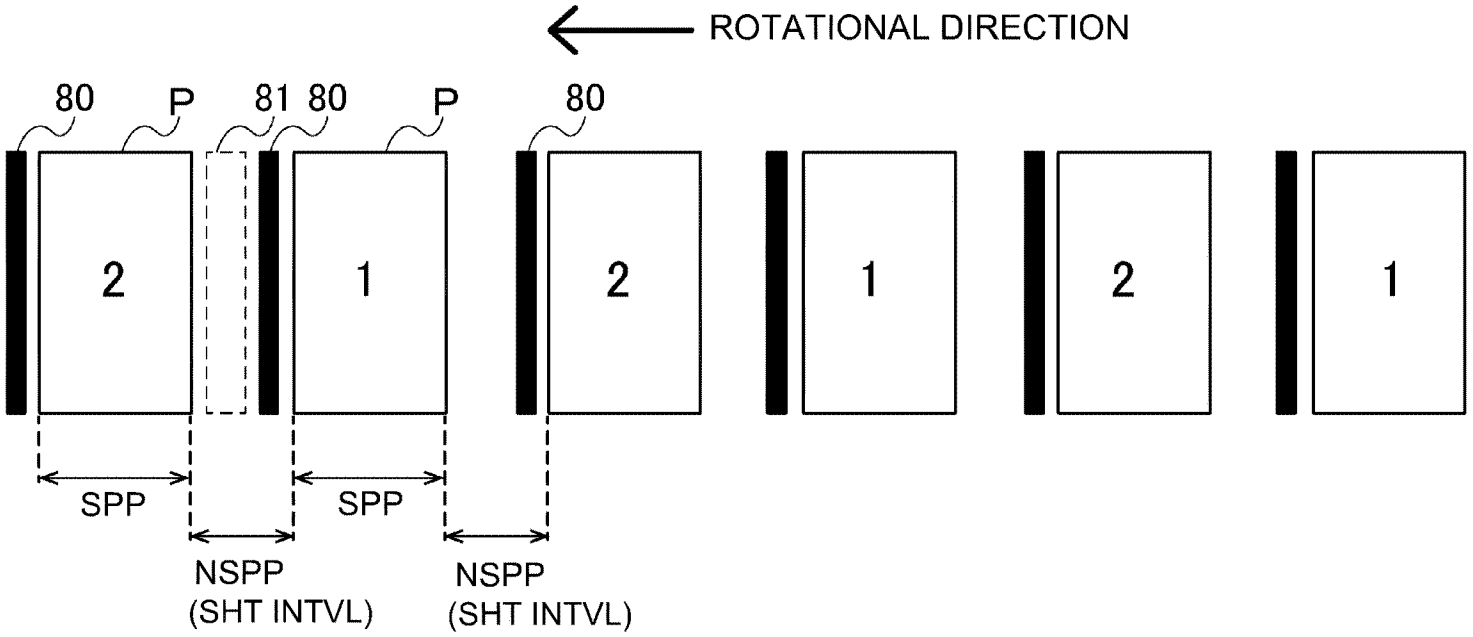
FIG. 20 is a schematic view for illustrating a toner band formed in Ninth Embodiment.

Further, as shown in FIG. 19, in the case where the controller 200 discriminated that the image forming surface is the second surface (back surface) of the recording material P (YES of S3), the controller 200 executes the toner band forming control for forming the toner band on the secondary transfer belt 12 (S4). That is, the toner band is formed immediately in front of the recording material P for the second surface (image formation). The toner band formed at this time is, e.g., 5 mm in toner band length. Then, the controller 200 forms the toner image on the second surface of the recording material P (S5), and thereafter discriminates whether or not a cumulative sheet number (continuous print number) of sheets of the recording materials P continuously subjected to image formation during the continuous image forming job is not less than a predetermined value (e.g., 20 sheets) (S82). In the case where the cumulative sheet number is less than the predetermined value (NO of S82), the sequence goes to a process of S6. In the case where the cumulative sheet number is not less than the predetermined value (YES of S82), the toner band is formed immediately in the rear of the recording material P for the second surface after the toner image is formed (S5) (S11). The toner band formed in S11 is, e.g., 25 mm in toner band length. In FIG. 20, toner bands formed on the secondary transfer belt 12 in the case where the image forming process in this embodiment is performed are shown.

As shown in FIG. 20, the toner bands 80 and 81 are formed in sheet intervals between recording materials P. The toner band 80 of 5 mm in toner band length is always formed immediately in front of the recording material P for the first surface and immediately in front of the recording material P for the second surface in the downstream side with respect to the rotational direction of the secondary transfer belt 12. On the other hand, the toner band 81 of 25 mm in toner band length is formed at predetermined timing (based on the cumulative sheet number in this case) immediately in the rear of the recording material P for the second surface in the upstream side with respect to the rotational direction of the secondary transfer belt 12. That is, the toner band 80 as a first supplying toner image is always formed immediately in front of all the recording materials P for the second surface (image formation). On the other hand, the toner band 81 as a second supplying toner image is formed in addition to the toner band 80 in the case where the cumulative sheet number of the recording materials P on which the toner images are formed exceeds the threshold.

As described above, in Ninth Embodiment, the toner band 80 is always formed, while the toner band 81 is formed only at predetermined timing. As a result, it is possible to suppress the generation of the image defect due to the lump of the wax while suppressing the toner consumption. Further, the toner band 80 small in toner deposition amount is formed immediately in front of the recording material P for the first surface in the downstream side with respect to the rotational direction of the secondary transfer belt 12, so that the toner functioning as the lubricant is always ensured without uselessly increasing the toner consumption. As a result, the cleaning blade 90 does not readily generate minute vibration (so-called shuddering), so that a toner removing performance is prevented from lowering.

In the above-described Ninth Embodiment, the toner band of 25 mm in toner band length was formed, but the present invention is not limited thereto. A toner band larger in toner deposition amount than the toner band formed immediately in front of the recording material P for the second surface may also be formed. In summary, the amount of the toner supplied to the cleaning blade 90 may only be required to be larger than the amount of the toner band formed immediately in front of the recording material P for the second surface. Further, in the case where a cumulative value of the number of sheets of the recording materials P subjected to the image formation during the continuous image forming job is not less than the predetermined value, the toner band of 25 mm in toner band length is formed immediately in the rear of the recording material P for the second surface after the toner image is formed, but the present invention is not limited thereto. For example, as have already been described above, the toner band large in amount of the toner supplied to the cleaning blade 90 may also be formed immediately in the rear of the recording material P for the second surface in the case where the average image ratio is not less than the predetermined value or in the case where the image ratio of the recording material P for the first surface is not less than the predetermined value.

Other Embodiments

Figure 21:
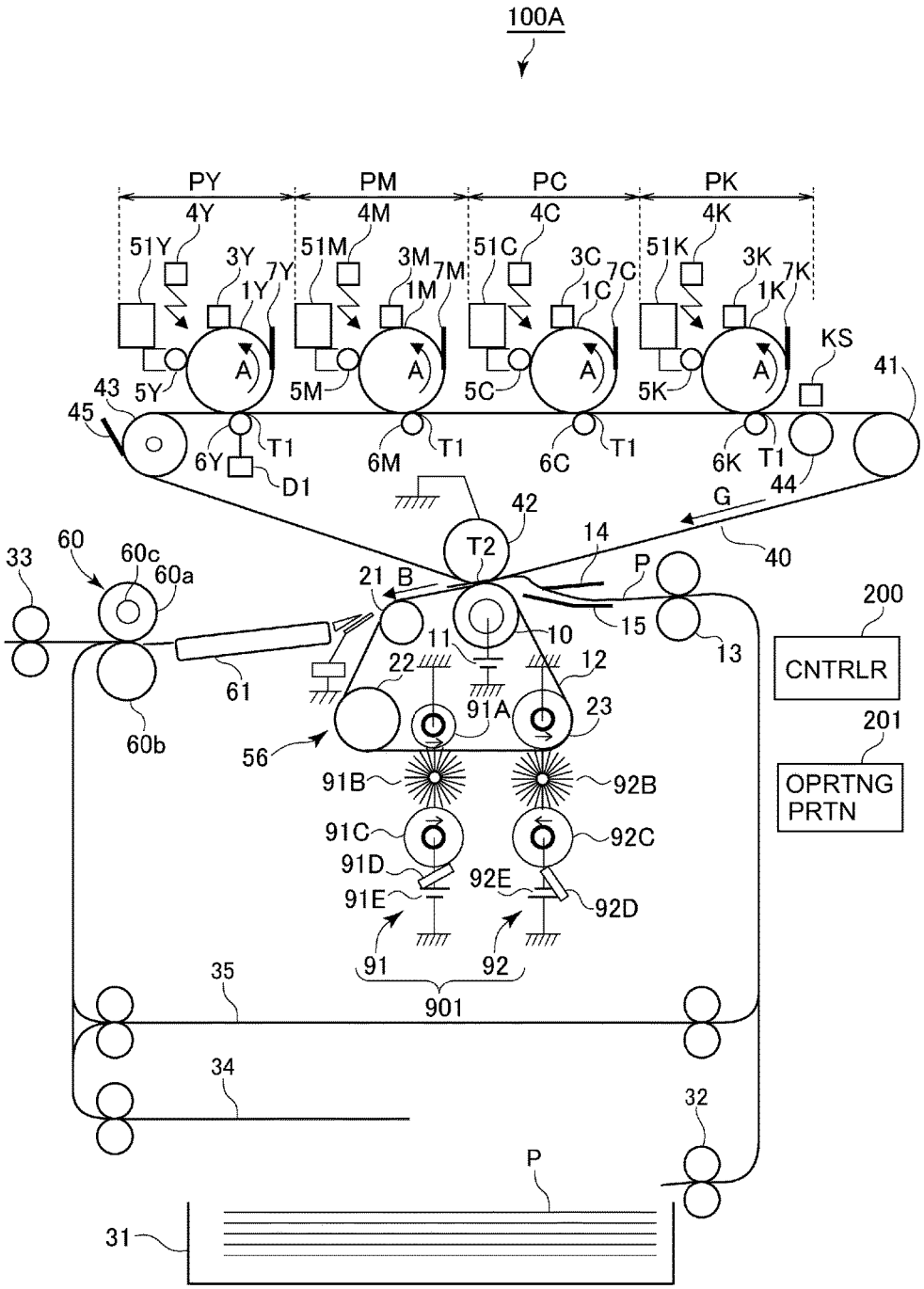
FIG. 21 is a schematic view showing an image forming apparatus including a secondary transfer belt cleaning device of an electrostatic type.

In the above-described First to Ninth Embodiments, as the cleaning means, the cleaning blade 90 was described as an example, but the present invention is not limited thereto. The cleaning means may also be a cleaning device of an electrostatic type. FIG. 21 shows an image forming apparatus including a secondary transfer belt cleaning device of the electrostatic type.

A secondary transfer belt cleaning device 901 shown in FIG. 21 collects a negatively charged toner by using a fur brush 91B to which a positive voltage is applied, and thereafter collects a positively charged toner by using a fur brush 92B to which a negative voltage is applied.

The fur brushes 91B and 92B as electrostatically removing rotatable members and metal rollers 91C and 92C as sliding removing rotatable members are connected with each other by a gear mechanism and are rotated in arrow directions by being driven by an unshown driving motor. Specifically, the fur brushes 91B and 92B rotate counterdirectionally with respect to a movement direction of the secondary transfer belt 12 and rub against the secondary transfer belt 12. The fur brush 92B rotates counterdirectionally also with respect to a rotational direction of the metal roller 92C and rubs against the metal roller 92C. The fur brush 91B rotates codirectionally with respect to the rotational direction of the metal roller 91C and rubs against the metal roller 91C.

A supporting roller 91A is a metal roller connected with the ground potential and is rotated by the secondary transfer belt 12, and supports the secondary transfer belt 12 rubbed with the fur brush 91B. A voltage source 91E applies a positive voltage to the metal roller 91C. The fur brush 91B contacting the metal roller 91C is positively charged and electrostatically attracts the toner which is deposited and negatively charged on the secondary transfer belt 12. The toner collected by the fur brush 91B is transferred onto the metal roller 91C higher in positive potential than the toner, and thereafter is scraped off the metal roller 91C by a cleaning blade 91D.

Further, the toner changed in charge polarity from the negative to the positive during deposition and rotation on the fur brush 91B is returned from the fur brush 91B to the secondary transfer belt 12, and thereafter is collected by the fur brush 92B during a process of passing through the fur brush 92B.

A driving roller 23 is a metal roller coated with an electroconductive rubber and rotationally drives the secondary transfer belt 12, and supports the secondary transfer belt 12 rubbed with the fur brush 92B. A voltage source 92E applies a negative voltage to the metal roller 92C. The fur brush 92B contacting the metal roller 92C is negatively charged and electrostatically attracts the toner which is deposited and positively charged on the secondary transfer belt 12. The toner collected by the fur brush 92B is transferred onto the metal roller 92C high in negative potential than the toner, and thereafter is scraped off the metal roller 92C by a cleaning blade 92D.

In the case where double-sided printing is made by the image forming apparatus 100, the wax contained in the toner image which has already been transferred on the recording material P facing the secondary transfer belt 12 can be deposited on the secondary transfer belt 12 from the recording material P during passing of the recording material P through the secondary transfer portion T2. Then, the wax deposited on the secondary transfer belt 12 can be transferred onto the fur brushes 91B and 92B. The wax transferred the fur brushes 91B and 92B is scraped off the fur brushes 91B and 92B by the cleaning blades 91D and 92D, but the wax can accumulate and deposit at edge portions of the cleaning blades 91D and 92D. Thus, a cleaning performance of the toner and the paper powder by the cleaning blades 91D and 92D remarkably lowers. Therefore, also in the case of the secondary transfer belt cleaning device 901 of the electrostatic type, the above-described embodiments may be applied.

In the above-described First to Ninth Embodiments, the constitution in which the toner band is formed on the secondary transfer belt 12 and supplies the toner to the cleaning blade 90 in order to clean the secondary transfer belt 12 was described, but the present invention is not limited thereto. For example, the toner band may also be formed on the intermediary transfer belt 40 and may also supply the toner to the intermediary transfer belt cleaning device 45 in order to clean the intermediary transfer belt 40. That is, the toner band carried on the intermediary transfer belt 40 may also be fed to the intermediary transfer belt cleaning device 45 as it is without being transferred onto the secondary transfer belt 12. As a result, the wax deposited on the intermediary transfer belt 40 via the secondary transfer belt 12 is prevented from accumulating and depositing at an edge portion of the intermediary transfer belt cleaning device 45, so that it is possible to suppress the generation of the image defect due to the lump of the wax.

Figure 22:
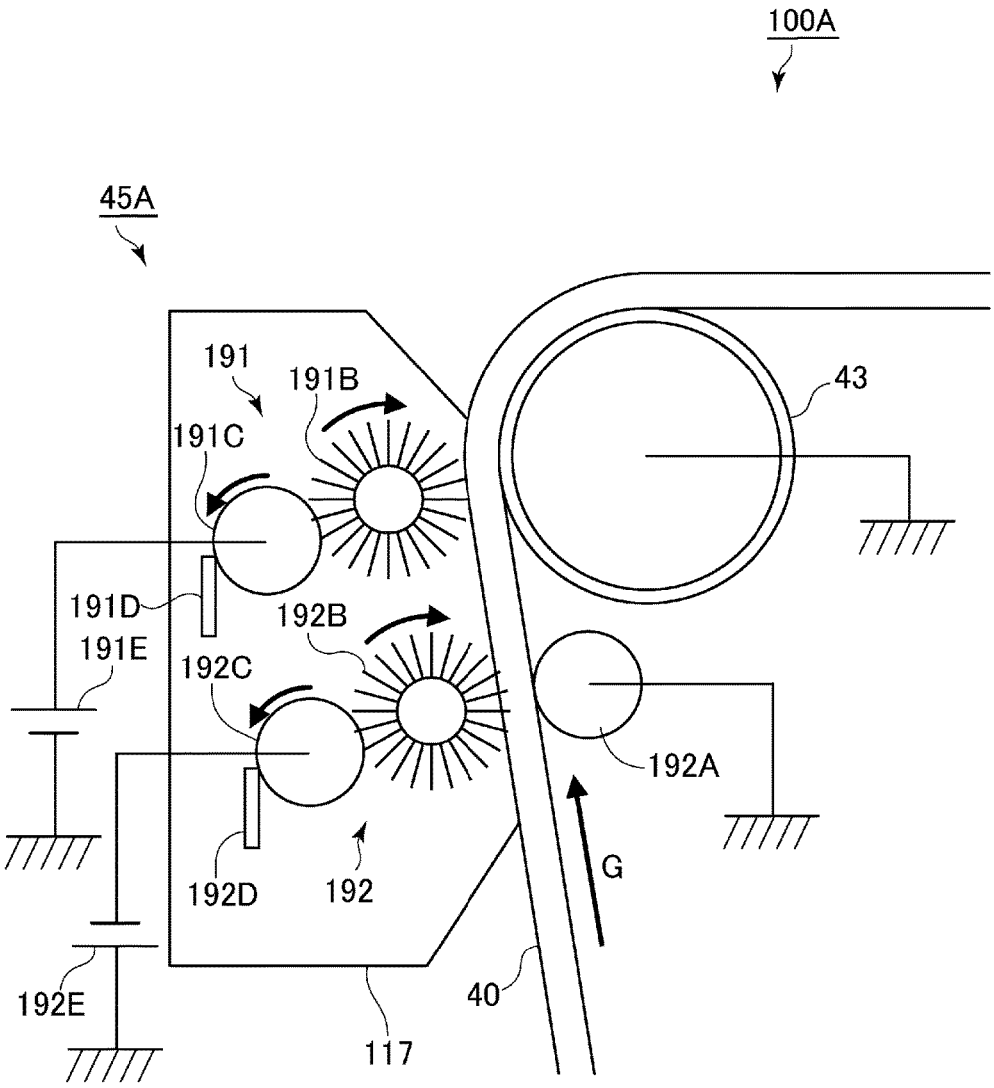
FIG. 22 is a schematic view showing an intermediary transfer belt cleaning device of an electrostatic type.

In the above-described First to Ninth Embodiments, the constitution in which the generation of the lump of the wax on the cleaning blade 90 for cleaning the secondary transfer belt 12 is suppressed was described, but the present invention is not limited thereto. The toner band is not transferred from the intermediary transfer belt 40 onto the secondary transfer belt 12, so that the toner may also be supplied to the intermediary transfer belt cleaning device 45 for cleaning the intermediary transfer belt 40. The intermediary transfer belt cleaning device 45 as the cleaning means is not limited to the cleaning blade (FIG. 1), but may also be a cleaning device of the electrostatic type. FIG. 22 shows an intermediary transfer belt cleaning device of the electrostatic type.

The intermediary transfer belt cleaning device 45A shown in FIG. 22 collects the toner charged to the positive polarity by using a fur brush 192B to which the bias voltage of the negative polarity (the same polarity as the charge polarity of the toner) is applied.

Thereafter, the toner charged to the negative polarity is collected using a fur brush 191B to which a bias voltage of the positive polarity (the opposite polarity to the charge polarity of the toner) is applied. In this embodiment, the fur brush 192B rubs against the intermediary transfer belt 40 in an upstream side with respect to the rotational direction of the intermediary transfer belt 40, and the fur brush 191B rubs against the intermediary transfer belt 40 in a downstream side with respect to the rotational direction of the intermediary transfer belt 40.

The intermediary transfer belt cleaning device 45A includes a first cleaning portion 191 and a second cleaning portion 192. The first cleaning portion 191 includes the fur brush 191B, a metal roller 191C, a voltage (power) source 191E and a cleaning blade 191D. The second cleaning portion 192 includes the fur brush 192B, a metal roller 192C, a voltage source 192E, and a cleaning blade 192D. The fur brushes 191B and 192B as the electrostatically removing rotatable members and the metal rollers 191C and 192C as the rubbing rotatable members are connected by an unshown gear mechanism and are rotated by an unshown driving motor. The fur brushes 191B and 192B rotate in an opposite direction to the rotational direction of the intermediary transfer belt 40 at contact positions with the intermediary transfer belt 40, respectively, and rub against the intermediary transfer belt 40. The fur brush 191B rubs against the peripheral surface of the intermediary transfer belt 40 after the fur brush 192B rubs against the peripheral surface of the intermediary transfer belt 40.

Further, the fur brushes 191B and 192B rub against the metal rollers 191C and 192C, respectively. The fur brush 191B rubs against the metal roller 191C at a contacted position with the metal roller 191C by being rotated codirectionally with the rotational direction of the metal roller 191C. The fur brush 192B rubs against the metal roller 192C at a contacted position with the metal roller 192C by being rotated codirectionally with the rotational direction of the metal roller 192C.

A supporting roller 192A is a metal roller grounded to the ground potential (0 V), and supports the intermediary transfer belt 40, against which the fur brush 192B rubs, from an inner peripheral surface side, and is rotated by the intermediary transfer belt 40. The supporting roller 192A is a cylindrical roller and is formed in a diameter of, e.g., 13 mm. The driving roller 43 is a metal roller connected to the ground potential (0 V) and supports the intermediary transfer belt 40, against which the fur brush 191B rubs, from the inner peripheral surface side of the intermediary transfer belt 40, and rotationally drives the intermediary transfer belt 40 as described above.

The voltage source 192E generates an electric field between the fur brush 192B and the supporting roller 192A by applying a voltage of the negative polarity to the metal roller 192C. As a result, the fur brush 192B rubbing against the metal roller 192C is charged to the negative polarity and thus is capable of attracting the toner which is deposited on the intermediary transfer belt 40 and which is charged to the positive polarity. The toner attracted to the fur brush 192B is moved to the metal roller 192C higher in potential of the negative polarity, and then is scraped off by the cleaning blade 192D. The cleaning blade 192D contacts the metal roller 192C counterdirectionally to the rotational direction of the metal roller 192C and scrapes the toner off the metal roller 192C.

On the other hand, the voltage source 191E generates an electric field between the fur brush 191B and the driving roller 43 by applying a voltage of the positive polarity to the metal roller 191C. As a result, the fur brush 191B rubbing against the metal roller 191C is charged to the positive polarity and thus is capable of attracting the toner which is deposited on the intermediary transfer belt 40 and which is charged to the negative polarity. The toner attracted to the fur brush 191B is moved to the metal roller 191C higher in potential of the positive polarity, and then is scraped off by the cleaning blade 191D. The cleaning blade 191D contacts the metal roller 191C counterdirectionally to the rotational direction of the metal roller 191C and scrapes the toner off the metal roller 191C.

In the case where double-sided printing is made by the image forming apparatus 100, the wax contained in the toner image which has already been transferred on the recording material P facing the secondary transfer belt 12 can be deposited on the secondary transfer belt 12 from the recording material P during passing of the recording material P through the secondary transfer portion T2. Then, the wax deposited on the secondary transfer belt 12 can be transferred onto the fur brushes 91B and 92B. The wax transferred the fur brushes 91B and 92B is scraped off the fur brushes 91B and 92B by the cleaning blades 91D and 92D, but the wax can accumulate and deposit at edge portions of the cleaning blades 91D and 92D. Thus, a cleaning performance of the toner and the paper powder by the cleaning blades 91D and 92D remarkably lowers. Therefore, also in the case of the intermediary transfer belt cleaning device 45A of the electrostatic type, the above-described embodiments may be similarly applied.

In the above-described embodiments, the secondary transfer belt unit was used, but the present invention is not limited thereto, and a secondary transfer roller may also be used.

Incidentally, in the above-described embodiments, the image forming apparatus was described using the multicolor printer as an example. However, the present invention is not limited thereto, but is applicable to any image forming apparatus as long as the apparatus effects the secondary transfer by using the intermediary transfer memory. The present invention can be carried out by the image forming apparatus effecting the secondary transfer by using the intermediary transfer member, regardless of whether the apparatus is of tandem type, single drum type, the charging type, the electrophotographic image forming type, the developing type, the transfer type, and the fixing type. Examples of such image forming apparatuses may include printers, various printing machines, copying machines, facsimile machines, multifunction (image forming) machines, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-133805 filed on Jul. 2, 2015, which is hereby incorporated by reference herein in its entirety.

What is claimed is:

1. An image forming apparatus comprising:

an image bearing member configured to bear a toner image;

a developing device configured to develop, with toner containing a wax, an electrostatic latent image formed on said image bearing member;

an intermediary transfer member onto which a toner image formed on said image bearing member is transferred;

a rotatable transfer member configured to form a transfer portion in contact with an outer surface of said intermediary transfer member, wherein the toner image formed on said intermediary transfer member is transferred onto a recording material at the transfer portion;

a cleaning device configured to remove the toner deposited on said rotatable transfer member, said cleaning device including a blade contacting said rotatable transfer member or a blade contacting a rotatable member for feeding the toner collected from said rotatable transfer member;

a fixing device including a heating roller configured to fix the toner image by heating the recording material;

a feeding portion configured to turn the recording material passing through said fixing device upside down and configured to feed the recording material to the transfer portion; and a controller configured to execute a supplying operation for supplying a supplying toner image to said cleaning device during a continuous double-sided job for carrying out continuous image formation on first and second surfaces of each of a plurality of recording materials, wherein the supplying toner image is formed in a region, corresponding to a region between a recording material and a subsequent recording material during the continuous image forming job, wherein said controller executes the supplying operation on the basis of:

(i) first information on image information on the image formed on each of the recording materials during the continuous double-sided image forming job, and (ii) second information for discriminating whether or not the first information is information on the image formed on the first surface of each of the recording materials.

2. An image forming apparatus according to claim 1, wherein said controller forms the supplying toner image over an entire contact region of said blade with respect to a longitudinal direction of said blade.

3. An image forming apparatus according to claim 1, wherein said controller executes the supplying operation on the basis of image information of the image formed on the first surface of each of the recording materials irrespective of image information of the image formed on the second surface of each of the recording materials.

4. An image forming apparatus according to claim 3, wherein said controller executes the supplying operation when a toner amount or an image ratio of the image formed on the first surface of the recording material is larger than a predetermined threshold.

5. An image forming apparatus according to claim 3, wherein said controller executes the supplying operation by dividing a region corresponding to the recording material into a plurality of regions with respect to a widthwise direction of said intermediary transfer member and acquiring the toner amount or the image ratio of the image formed on the first surface of the recording material for each of the regions and then forming the supplying toner image in a region where the toner amount or the image ratio exceeds the predetermined threshold.

6. An image forming apparatus according to claim 1, wherein said controller forms the supplying toner image in either one of regions adjacent to the predetermined recording material in front of and in the rear of the predetermined recording material when the image is formed on the second surface of the predetermined recording material on the basis of image information of the toner image formed on the first surface of the predetermined recording material.

* * * * *